US006297813B1

(12) United States Patent
Okada et al.

(10) Patent No.: US 6,297,813 B1
(45) **Date of Patent: *Oct. 2, 2001**

(54) DRIVING CIRCUIT FOR DISPLAY DEVICE

(75) Inventors: Hisao Okada, Ikoma-gun; Sunao Etoh, Tenri, both of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/872,991

(22) Filed: Jun. 11, 1997

(30) Foreign Application Priority Data

Jun. 18, 1996 (JP) ..... 8-157099

(51) Int. Cl.[7] ..... G09G 5/00
(52) U.S. Cl. ..... 345/204; 345/89
(58) Field of Search ..... 345/89, 94, 92, 345/204, 211, 98, 100

(56) References Cited

U.S. PATENT DOCUMENTS

| | | | | |
|---|---|---|---|---|
| 4,032,315 | | 6/1977 | van der Steen | 65/32 |
| 4,923,279 | | 5/1990 | Ainslie et al. | 350/96.3 |
| 4,978,378 | | 12/1990 | Ito et al. | 65/3.12 |
| 5,058,976 | | 10/1991 | DeGiovanni et al. | 359/173 |
| 5,155,621 | | 10/1992 | Takeda et al. | 359/337 |
| 5,262,365 | | 11/1993 | Oyobe | 501/54 |
| 5,278,850 | | 1/1994 | Ainslie et al. | 372/6 |
| 5,282,079 | | 1/1994 | Laming et al. | 359/341 |
| 5,319,797 | * | 6/1994 | Salter et al. | 455/38.2 |
| 5,396,245 | * | 3/1995 | Rempfer | 341/145 |
| 5,499,037 | * | 3/1996 | Nakagawa et al. | 345/89 |
| 5,583,531 | * | 12/1996 | Okada et al. | 345/89 |
| 5,635,950 | * | 6/1997 | Okada et al. | 345/95 |
| 5,784,041 | * | 6/1998 | Okada et al. | 345/89 |
| 5,784,072 | * | 7/1998 | Imamura | 345/508 |
| 5,929,847 | * | 7/1999 | Yanagi et al. | 345/204 |

FOREIGN PATENT DOCUMENTS

| | | |
|---|---|---|
| 0613866 | 9/1994 | (EP) . |
| 2203737 | 10/1988 | (GB) . |
| 5-273520 | 10/1993 | (JP) . |

OTHER PUBLICATIONS

Okada et al, "Development of a low Voltage Source Driver for Large TFT–LCD System for Computer Applications", IEEE, pp. 111–114, 1991.

Okada et al, "An 8–bit Digital Data Driver for AMLCDs", SID 94 Digest, pp. 347–350, 1994.

* cited by examiner

*Primary Examiner*—Bipin Shalwala
*Assistant Examiner*—Vanel Frenel
(74) *Attorney, Agent, or Firm*—Nixon & Vanderhye P.C.

(57) ABSTRACT

The driving circuit of this invention for a display device displaying a plurality of gray levels in accordance with digital data including a first bit portion and a second bit portion, includes: a voltage dividing circuit for generating a plurality of interpolation voltages between a plurality of gray level voltages supplied externally by dividing the plurality of gray level voltages; a first selection circuit for selecting a first voltage and a second voltage which is different from the first voltage among the plurality of gray level voltages and the plurality of interpolation voltages based on the first bit portion of the digital data; a second selection circuit for selecting one of a plurality of oscillating signals having different duty ratios based on the second bit portion of the digital data; and an output circuit for outputting an oscillating voltage which oscillates between the first voltage and the second voltage selected by the first selection circuit at a duty ratio of the oscillating signal selected by the second selection circuit.

25 Claims, 31 Drawing Sheets

Table 1

| D7 | D6 | D5 | D4 | D3 | D2 | S0 | S4 | S8 | S16 | S20 | S24 | S28 | S32 | S36 | S40 | --- | S220 | S224 | S228 | S232 | S236 | S240 | S244 | S248 | S252 | S256 |
|---|---|---|---|---|---|---|---|---|---|---|---|---|---|---|---|---|---|---|---|---|---|---|---|---|---|---|
| 0 | 0 | 0 | 0 | 0 | 0 | T | $\overline{T}$ | | | | | | | | | | | | | | | | | | | |
| 0 | 0 | 0 | 0 | 0 | 1 | | T | $\overline{T}$ | | | | | | | | | | | | | | | | | | |
| 0 | 0 | 0 | 0 | 1 | 0 | | | T | $\overline{T}$ | | | | | | | | | | | | | | | | | |
| 0 | 0 | 0 | 0 | 1 | 1 | | | | T | $\overline{T}$ | | | | | | | | | | | | | | | | |
| 0 | 0 | 0 | 1 | 0 | 0 | | | | | T | $\overline{T}$ | | | | | | | | | | | | | | | |
| 0 | 0 | 0 | 1 | 0 | 1 | | | | | | T | $\overline{T}$ | | | | | | | | | | | | | | |
| 0 | 0 | 0 | 1 | 1 | 0 | | | | | | | T | $\overline{T}$ | | | | | | | | | | | | | |
| 0 | 0 | 0 | 1 | 1 | 1 | | | | | | | | T | $\overline{T}$ | | | | | | | | | | | | |
| 0 | 0 | 1 | 0 | 0 | 0 | | | | | | | | | T | $\overline{T}$ | | | | | | | | | | | |
| 1 | 1 | 0 | 1 | 1 | 1 | | | | | | | | | | | | | | | | | | | | | |
| 1 | 1 | 1 | 0 | 0 | 0 | | | | | | | | | | | | | T | $\overline{T}$ | | | | | | | |
| 1 | 1 | 1 | 0 | 0 | 1 | | | | | | | | | | | | | | T | $\overline{T}$ | | | | | | |
| 1 | 1 | 1 | 0 | 1 | 0 | | | | | | | | | | | | | | | T | $\overline{T}$ | | | | | |
| 1 | 1 | 1 | 0 | 1 | 1 | | | | | | | | | | | | | | | | T | $\overline{T}$ | | | | |
| 1 | 1 | 1 | 1 | 0 | 0 | | | | | | | | | | | | | | | | | T | $\overline{T}$ | | | |
| 1 | 1 | 1 | 1 | 0 | 1 | | | | | | | | | | | | | | | | | | T | $\overline{T}$ | | |
| 1 | 1 | 1 | 1 | 1 | 0 | | | | | | | | | | | | | | | | | | | T | $\overline{T}$ | |
| 1 | 1 | 1 | 1 | 1 | 1 | | | | | | | | | | | | | | | | | | | | T | $\overline{T}$ |

Fig. 30

Table 3

| $D_7$ | $D_6$ | $D_5$ | $D_4$ | $D_3$ | $S_0$ | $S_8$ | $S_{16}$ | $S_{24}$ | $S_{32}$ | $S_{40}$ | $S_{48}$ | $S_{56}$ | $S_{64}$ | $S_{72}$ | $S_{80}$ | $S_{88}$ | $S_{96}$ -- | --- $S_{192}$ | $S_{200}$ | $S_{208}$ | $S_{216}$ | $S_{224}$ | $S_{232}$ | $S_{240}$ | $S_{248}$ | $S_{256}$ |
|---|---|---|---|---|---|---|---|---|---|---|---|---|---|---|---|---|---|---|---|---|---|---|---|---|---|---|
| 0 | 0 | 0 | 0 | 0 | T | $\overline{T}$ | | | | | | | | | | | | | | | | | | | | |
| 0 | 0 | 0 | 0 | 1 | | T | $\overline{T}$ | | | | | | | | | | | | | | | | | | | |
| 0 | 0 | 0 | 1 | 0 | | | T | $\overline{T}$ | | | | | | | | | | | | | | | | | | |
| 0 | 0 | 0 | 1 | 1 | | | | T | $\overline{T}$ | | | | | | | | | | | | | | | | | |
| 0 | 0 | 1 | 0 | 0 | | | | | T | $\overline{T}$ | | | | | | | | | | | | | | | | |
| 0 | 0 | 1 | 0 | 1 | | | | | | T | $\overline{T}$ | | | | | | | | | | | | | | | |
| 0 | 0 | 1 | 1 | 0 | | | | | | | T | $\overline{T}$ | | | | | | | | | | | | | | |
| 0 | 0 | 1 | 1 | 1 | | | | | | | | T | $\overline{T}$ | | | | | | | | | | | | | |
| 0 | 1 | 0 | 0 | 0 | | | | | | | | | T | $\overline{T}$ | | | | | | | | | | | | |
| 0 | 1 | 0 | 0 | 1 | | | | | | | | | | T | $\overline{T}$ | | | | | | | | | | | |
| 0 | 1 | 0 | 1 | 0 | | | | | | | | | | | T | $\overline{T}$ | | | | | | | | | | |
| 0 | 1 | 0 | 1 | 1 | | | | | | | | | | | | T | $\overline{T}$ | | | | | | | | | |
| 0 | 1 | 1 | 0 | 0 | | | | | | | | | | | | | | | | | | | | | | |
| 1 | 0 | 1 | 1 | 0 | | | | | | | | | | | | | | | | | | | | | | |
| 1 | 0 | 1 | 1 | 1 | | | | | | | | | | | | | | | | | | | | | | |
| 1 | 1 | 0 | 0 | 0 | | | | | | | | | | | | | | T | $\overline{T}$ | | | | | | | |
| 1 | 1 | 0 | 0 | 1 | | | | | | | | | | | | | | | T | $\overline{T}$ | | | | | | |
| 1 | 1 | 0 | 1 | 0 | | | | | | | | | | | | | | | | T | $\overline{T}$ | | | | | |
| 1 | 1 | 0 | 1 | 1 | | | | | | | | | | | | | | | | | T | $\overline{T}$ | | | | |
| 1 | 1 | 1 | 0 | 0 | | | | | | | | | | | | | | | | | | T | $\overline{T}$ | | | |
| 1 | 1 | 1 | 0 | 1 | | | | | | | | | | | | | | | | | | | T | $\overline{T}$ | | |
| 1 | 1 | 1 | 1 | 0 | | | | | | | | | | | | | | | | | | | | T | $\overline{T}$ | |
| 1 | 1 | 1 | 1 | 1 | | | | | | | | | | | | | | | | | | | | | T | $\overline{T}$ |

Fig. 31

DRIVING CIRCUIT FOR DISPLAY DEVICE

BACKGROUND OF THE INVENTION

1. Field of the Invention

The present invention relates to a driving circuit for an active matrix type flat display device. More particularly, the present invention relates to a driving circuit for a liquid crystal display device which realizes gray-level display with 256 or more gray levels.

2. Description of the Related Art

FIG. 17 shows a configuration of a conventional driving circuit corresponding to one output of a 3-bit digital driver.

The driving circuit of FIG. 17 includes a sampling memory 131, a hold memory 132, and an output circuit 133. In response to a rising edge of a sampling pulse $T_{smp}$, 3-bit digital data $D_0$ to $D_2$ are stored in the sampling memory 131. The digital data stored in the sampling memory 131 are then transferred in response to a rising edge of an output pulse OP to the hold memory 132 to be held therein. The output circuit 133 outputs one of gray level voltages $V_0$ to $V_7$ supplied externally in accordance with the values of the digital data held in the hold memory 132 as an output voltage Out.

FIG. 18 shows a configuration of the output circuit 133 which includes a 3-to-8 decoder 141 and eight analog switches $ASW_0$ to $ASW_7$. The decoder 141 turns on one of the analog switches $ASW_0$ to $ASW_7$ in accordance with the values of the digital data. A gray level voltage supplied to the turned-on analog switch is output as the output voltage Out.

A digital driver having the configuration shown in FIGS. 17 and 18 has advantages of simple structure and small power consumption and thus has been widely used. Such a digital driver is described, for example, in H. Okada et al., "Development of a low voltage source driver for large TFT-LCD system for computer applications", 1991, International Display Research Conference, pp. 111–114.

The conventional digital driver having the above configuration requires the same number of gray level sources as the number of gray levels to be displayed. This causes no problem for a 3-bit digital driver, but may cause a problem when a digital driver is driven with more than 3 bits because the number of required gray level sources becomes too large. Specifically, it is practically impossible to realize a 6 or more bit digital driver with the above configuration to provide a display with a large number of gray levels.

To overcome the above problem, various techniques have been proposed for realizing a display with a large number of gray levels by generating interpolation voltages between gray level voltages supplied externally.

One example of such techniques is disclosed in Japanese Laid-Open Patent Publication No. 5-273520, which describes a circuit for generating interpolation voltages between adjacent gray level voltages by dividing the gray level voltages by use of resistances in a driver. Hereinbelow, this technique of generating interpolation voltages by use of resistance is referred to as a "resistance division technique".

FIG. 19 shows a driving circuit 151 and a voltage dividing circuit 152 described in Japanese Laid-Open Patent Publication No. 5-273520 mentioned above. The driving circuit 151 corresponds to one output of a 4-bit digital driver.

The voltage dividing circuit 152 divides five external gray level voltages $V_0$, $V_4$, $V_8$, $V_{12}$, and $V_{15}$ by use of resistances to generate one or more interpolation voltages between every two adjacent gray level voltages. As a result, total 16 voltages $V_0$ to $V_{15}$ composed of the five gray level voltages and 11 interpolation voltages are supplied to the driving circuit 151.

The driving circuit 151 selects one of the 16 voltages $V_0$ to $V_{15}$ supplied from the voltage dividing circuit 152, and outputs the selected voltage via a buffer amplifier 157.

Referring to FIGS. 20A, 20B, 21, and 22, an application of the technique disclosed in Japanese Laid-Open Patent Publication No. 5-273520 mentioned above to a 6-bit digital driver will be described.

FIG. 20A shows a configuration of a voltage dividing circuit 162, which divides nine external gray level voltages $V_0$, $V_8$, $V_{16}$, $V_{24}$, $V_{32}$, $V_{40}$, $V_{48}$, $V_{56}$, and $V_{64}$ by use of resistances to generate seven interpolation voltages between every adjacent gray level voltages. As a result, 64 total voltages $V_0$ to $V_{63}$ composed of eight gray level voltages and 56 interpolation voltages are supplied to a driving circuit 161.

FIG. 20B shows an array of eight resistances connected in series between the gray level voltages $V_0$ and $V_8$ shown in FIG. 20A. Such an array of eight resistances is also provided between any of the other adjacent gray level voltages.

FIG. 21 shows a configuration of the driving circuit 161 which corresponds to one output of the 6-bit digital driver.

FIG. 22 shows a configuration of an output circuit 173 of the driving circuit 161 of FIG. 21. The output circuit 173 includes a 6-to-64 decoder 181 and 64 analog switches $ASW_0$ to $ASW_{63}$. The 64 voltages $V_0$ to $V_{63}$ output from the voltage dividing circuit 162 are supplied to the analog switches $ASW_0$ to $ASW_{63}$, respectively. The decoder 181 turns on one of the analog switches $ASW_0$ to $ASW_{63}$ in accordance with the value of digital data. A voltage supplied to the turned-on analog switch is output via a buffer amplifier 183 as an output voltage Out.

An "oscillating voltage technique" is also known as a technique for realizing a display with a large number of gray levels by generating interpolation voltages between gray level voltages supplied externally. The oscillating voltage technique is based on a principle completely different from that of the resistance division technique described above. The principle of the oscillating voltage technique will be described.

It is generally known that a periodic function can be expanded to a Fourier series as long as it can be integrated. Therefore, a voltage which oscillates between a voltage $v_i$ and a voltage $v_j$ at a duty ratio of m:n as shown in FIG. 23 is represented by Expression (1) below as a function f(t).

$$f(t) = \frac{a_o}{2} + \sum_{n=1}^{\infty}(a_n \cos nt + b_n \sin nt) \tag{1}$$

$$a_n = \frac{1}{\pi}\int_{-\pi}^{\pi} f(t)_{\cos} nt \cdot dt \quad (n = 1, 2, 3\ldots)$$

$$b_n = \frac{1}{\pi}\int_{-\pi}^{\pi} f(t)_{\sin} nt \cdot dt \quad (n = 1, 2, 3\ldots)$$

$$\frac{a_o}{2} = \frac{mVi + nVj}{m+n}$$

The first term of the function f(t) represents a DC component shown as an average voltage and the second term thereof represents a periodic component. If the periodic component of the function f(t) can be removed somehow, a pixel electrode which receives an oscillating voltage as shown in FIG. 23 from a driver has an effect substantially equivalent to that the pixel electrode may have when it receives only a DC component represented by the first term of the function f(t).

If the route extending from a data line to a pixel electrode via a TFT is considered as a load of a driver, the route has characteristics as a low-pass filter determined based on a resistance component and a capacitance component existing on the route. If the frequency of the oscillating voltage is set sufficiently higher than a cut-off frequency determined by the characteristics as the low-pass filter, the value of the second term of the function f(t) can be sufficiently suppressed. As a result, a DC voltage shown as an average voltage is applied to the pixel electrode. Thus, in the oscillating voltage technique, a periodic component of an oscillating voltage output to a data line is suppressed using the characteristics of the route extending from the data line to the pixel electrode as the low-pass filter, so that only the DC component of the oscillating voltage is applied to the pixel electrode.

FIG. 24A shows a configuration of a circuit which corresponds to one output of a 6-bit digital driver according to the oscillating voltage technique. The circuit receives nine gray level voltages supplied externally and four interpolation signals $t_1$ to $t_4$ generated inside the driver. As shown in FIG. 24B, the interpolation signals $t_1$ to $t_4$ have duty ratios of 7:1, 6:2, 5:3, and 4:4, respectively.

A logic circuit 191 selects two adjacent gray level voltages from the nine gray level voltages based on the values of the three most significant bits $D_5$ to $D_3$ of digital data. The logic circuit 191 also selects one of total eight signals, i.e., a signal having a duty ratio of 8:0, the signals $t_1$ to $t_4$, and signals $t_1$ bar to $t_3$ bar obtained by inverting the signals $t_1$ to $t_3$, based on the values of the three least significant bits $D_2$ to $D_0$. The duty ratios of the eight signals are 8:0, 7:1, 6:2, 5:3, 4:4, 3:5, 2:6, 1:7, respectively. As a result, an oscillating voltage which oscillates between the two gray level voltages selected based on the values of the three most significant bits at a duty ratio selected based on the values of the three least significant bits is obtained, and output to a data line connected to a pixel electrode. See Japanese Patent Publication No. 7-7248 (U.S. Pat. No. 5,583,531) for details of the oscillating voltage technique.

A 6-bit digital driver realizing 64 gray levels can be obtained without so much difficulty by the above-described conventional techniques. However, it is very difficult to obtain an 8-bit digital driver realizing more than 64 gray levels, e.g., 256 gray levels.

FIG. 25A shows a configuration of a voltage dividing circuit 192 for an 8-bit digital driver according to the resistance division technique. FIG. 25B shows a resistance array between gray level voltages $V_0$ and $V_{32}$ shown in FIG. 25A. Such a resistance array is also provided between any of the other adjacent gray level voltages.

According to the resistance division technique, the voltage dividing circuit 162 for the 6-bit digital driver needs 64 resistances as shown in FIGS. 20A and 20B since eight resistances are required between every two adjacent gray level voltages. For the 8-bit digital driver, the voltage dividing circuit 192 needs 256 resistances since 32 resistances are required between every two adjacent gray level voltages.

The 8-bit digital driver thus requires four times as many resistances as the 6-bit digital driver. This increases the area occupied by the voltage dividing circuit. Moreover, it is not easy to form a number of resistances in an LSI with high precision. If the values of the resistances vary, the resultant voltages obtained by the division deviate.

In the 6-bit digital driver, 64 voltages $V_0$ to $V_{63}$ are supplied from the voltage dividing circuit 162 to the driving circuit 161. In the 8-bit digital driver, 256 voltages $V_0$ to $V_{255}$ are supplied from the voltage dividing circuit 192 to a driving circuit.

Voltages output from the voltage dividing circuit are supplied to the driving circuit via voltage supply lines. Therefore, the 8-bit digital driver requires four times as many voltage supply lines as the 6-bit digital driver. This increases the area occupied by the voltage supply lines of the 8-bit digital driver by four times, resulting in increasing the chip area.

FIG. 26 shows a configuration of an output circuit 203 of the driving circuit of the 8-bit digital driver according to the resistance division technique.

An 8-to-256 decoder 211 of the output circuit 203 of the 8-bit digital driver requires a considerably large number of logic gates compared with the 6-to-64 decoder 181 of the output circuit 173 of the 6-bit digital driver. Also, the output circuit 203 of the 8-bit digital driver requires four times as many analog switches as the output circuit 173 of the 6-bit digital driver. The output circuit 203 of the 8-bit digital driver therefore becomes considerably large compared with the output circuit 173 of the 6-bit digital driver.

The decoder is not necessarily composed of a combination of logic gates. For example, the decoder may be composed of read-only memories (ROMs). Using ROMs, however, the 8-to-256 decoder 211 still becomes considerably large compared with the 6-to-64 decoder 181.

One driver includes the same number of output circuits as the number of drive terminals. As the size of the output circuit increases, therefore, the size of an LSI constituting the driver considerably increases.

For example, assume that a driver has 240 drive terminals. When the size of one output circuit corresponds to 50 gates, the size of the entire driver corresponds to 12000 (=50×240) gates. When the size of one output circuit corresponds to 100 gates, the size of the entire driver corresponds to 24000 (=100×240) gates. Thus, though one driving circuit only has additional 50 gates, as many as 12000 gates are added in the entire driver.

Due to the above-described reasons, it is considerably difficult to realize an 8-bit digital driver by the mere extension of the conventional resistance division technique.

FIG. 27 shows a configuration of a circuit which corresponds to one output of an 8-bit digital driver according to the oscillating voltage technique. oscillating signals $t_1$ to $t_{16}$ have duty ratios of 31:1, 30:2, 29:3, 28:4, 27:5, 26:6, 25:7, 24:8, 23:9, 22:10, 21:11, 20:12, 19:13, 18:14, 17:15, and 16:16, respectively.

A logic circuit 253 selects two adjacent gray level voltages from nine gray level voltages $V_{32i}$ (i=0, 1, 2, . . . , 8) based on the values of the three most significant bits $D_7$ to $D_5$ of digital data. The logic circuit 253 also selects one of 32 signals including a signal having a duty ratio of 32:0 based on the values of the five least significant bits of the digital data, as in the case of the 6-bit digital driver. As a result, an oscillating voltage which oscillates between the selected two gray level voltages at a duty ratio of a selected signal is output.

As described above, the 8-bit digital driver according to the oscillating voltage technique appears to be more practical than the 8-bit digital driver according to the resistance division technique. Nonetheless, the logic circuit 253 of the 8-bit digital driver becomes considerably large compared with the logic circuit of the 6-bit digital driver. This increases the chip size of the resultant LSI.

Another problem is that as the number of bits increases the minimum pulse width of the oscillating signal becomes significantly small. For example, consider two cases where a potential difference is equally divided into eight and where the same potential difference is equally divided into 32 for an oscillating voltage with the same frequency. The minimum pulse width obtained when the potential difference is divided into 32 is only a quarter of that obtained when it is divided into eight.

FIG. 28A shows a waveform of a signal having the minimum pulse width in the 6-bit digital driver. FIG. 28B shows a waveform of a signal having the minimum pulse width in the 8-bit digital driver. The output circuit of a driver needs to be designed to be operable for the minimum pulse width. This means that analog switches of the output circuit of the 8-bit digital driver where the minimum pulse width is a quarter of that in the 6-bit digital driver need to be designed to be operable at a speed, i.e., a frequency, substantially four times as high as those of the 6-bit digital driver. Hereinbelow, such a frequency is referred to as a "substantial frequency".

It would be understood that, if the frequency of an oscillating signal used in the 8-bit digital driver is reduced to a quarter of that used in the 6-bit digital driver, the minimum pulse widths of the two digital drivers becomes the same. Therefore, in this case, the same substantial frequency as that for the 6-bit digital driver may be used for the 8-bit digital driver.

However, as described in Japanese Patent Publication No. 7-7248 (U.S. Pat. No. 5,583,531) mentioned above, the frequency of an oscillating signal is an important factor for determining the deviation of a voltage to be applied to a pixel electrode. In order to unify the deviation of the voltage, reducing the frequency of the oscillating signal is not allowed. Moreover, the deviation of the voltage allowable for the 8-bit digital driver should preferably be smaller than that allowable for the 6-bit digital driver. To achieve this, the frequency of an oscillating signal used in the 8-bit digital driver needs to be higher than that used in the 6-bit digital driver.

When the frequency of the oscillating signal used in the 8-bit digital driver is the same as that used in the 6-bit digital driver, the substantial frequency for the former is four times that for the latter. If the frequency of the oscillating signal used in the 8-bit digital driver is made twice that used in the 6-bit digital driver to reduce the deviation of the voltage applied to a pixel electrode, the substantial frequency for the former becomes eight times that for the latter.

The substantial frequency can be increased by increasing the current capacity of the analog switches of the output circuit. An analog switch with a larger current capacity turns on more swiftly for a same capacitive load. This results in increasing the substantial frequency.

In order to increase the current capacity of an analog switch, however, the width of a transistor constituting the analog switch should be increased. This greatly affects the chip size. More specifically, one analog switch is generally composed of four MOS transistors. One output circuit includes a plurality of analog switches. One driver includes a number of output circuits. An increase of the size of one analog switch therefore greatly increases the size of the entire driver.

As the size of the gate of an MOS transistor increases, the capacity of the gate increases. The increase in the gate capacity causes an increase in power consumed when the analog switch is switched because power consumption is proportional to the capacity. As a result, the power consumption of the entire driver increases.

A factor which increases the power consumption of the entire driver more significantly than the gate capacity is a current flowing through the CMOS analog switch when the analog switch is switched, i.e., a through current. The through current increases in proportion to the increase of the gate width. This increase of the through current also increases the power consumption of the entire driver.

For the reasons described above, although the 8-bit digital driver according to the oscillating voltage technique is practicable, many restrictions still exist for the designing of an idealistic driver in the aspects of the chip size and power consumption. These restrictions also block the fabrication of a display device driven with such a driver.

The 8-bit digital driver according to the oscillating voltage technique is described in H. Okada et al., "An 8-bit digital data driver for AM LCDs", SID'94 Digest, pp. 347–350, for example.

Thus, to summarize the above, an 8 or more bit digital driver cannot be realized by the conventional resistance division technique. An 8-bit digital driver according to the conventional oscillating voltage technique can be realized and has already been realized.

However, increasing the substantial frequency for the 8-bit digital driver is limited because it increases the chip size and power consumption. As a result, the fabrication of a liquid crystal display device driven with such a driver is restricted.

An objective of the present invention is to provide a digital driver where advantages of the resistance division technique and the oscillating voltage technique are utilized, while shortcomings of these techniques are suppressed.

Specifically, an objective of the present invention is to realize not only an 8-bit digital driver realizing 256 gray levels, but also a 10-bit digital driver realizing 1024 gray levels which is considered impossible by conventional techniques.

Since human eyes are believed to have a resolution of about 1000 gray levels, it is meaningless to provide a resolution of more than 1000 gray levels. The 10-bit digital driver realizing 1024 gray levels is therefore an ultimate driver.

SUMMARY OF THE INVENTION

The driving circuit of this invention for a display device displaying a plurality of gray levels in accordance with digital data including a first bit portion and a second bit portion, includes: a voltage dividing circuit for generating a plurality of interpolation voltages between a plurality of gray level voltages supplied externally by dividing the plurality of gray level voltages; a first selection circuit for selecting a first voltage and a second voltage which is different from the first voltage among the plurality of gray level voltages and the plurality of interpolation voltages based on the first bit portion of the digital data; a second selection circuit for selecting one of a plurality of oscillating signals having different duty ratios based on the second bit portion of the digital data; and an output circuit for outputting an oscillating voltage which oscillates between the first voltage and the second voltage selected by the first selection circuit at a duty ratio of the oscillating signal selected by the second selection circuit.

Alternatively, the driving circuit of this invention for a display device displaying a plurality of gray levels in accordance with digital data including a first bit portion, a second bit portion, and a third bit portion, includes: a first selection circuit for selecting a first gray level voltage and a second gray level voltage which is different from the first gray level voltage among a plurality of gray level voltages supplied externally based on the first bit portion of the digital data; a voltage dividing circuit for generating a plurality of interpolation voltages between the first gray level voltage and the second gray level voltage by dividing a potential difference between the first gray level voltage and the second gray level voltage; a second selection circuit for selecting a first voltage and a second voltage which is different from the first voltage among the first gray level voltage, the second gray level voltage, and the plurality of interpolation voltages based on the second bit portion of the digital data; a third selection circuit for selecting one of a plurality of oscillating signals having different duty ratios based on the third bit portion of the digital data; and an output circuit for outputting an oscillating voltage which oscillates between the first voltage and the second voltage selected by the second selection circuit at a duty ratio of the oscillating signal selected by the third selection circuit.

In one embodiment of the invention, the driving circuit further includes an impedance converter connected to the output circuit.

Thus, according to a driving circuit of the present invention, a plurality of interpolation voltages are generated between a plurality of gray level voltages supplied externally by the voltage dividing circuit. An oscillating voltage which oscillates between two voltages selected among the plurality of gray level voltages and the plurality of interpolation voltages output from the voltage dividing circuit is generated. The two voltages are selected based on the first bit portion (e.g., the most significant bits) of digital data. The duty ratio of the oscillating voltage is determined based on the second bit portion (e.g., the least significant bits). In this way, an interpolation gray level can be further obtained by the oscillating voltage technique between interpolation gray levels obtained by the resistance division technique.

According to another driving circuit of the present invention, two gray level voltages are selected among a plurality of gray level voltages supplied externally based on the first bit portion (e.g., the most significant bits) of digital data. The selected two gray level voltages are applied to both ends of the voltage dividing circuit, so that a plurality of interpolation voltages are generated between the two gray level voltages. An oscillating voltage which oscillates between two voltages selected among the two gray level voltages and the plurality of interpolation voltages output from the voltage dividing circuit is output from the output circuit. The two voltages are selected based on the second bit portion (e.g., intermediate bits) of the digital data. The duty ratio of the oscillating voltage is determined based on the third bit portion (e.g., the least significant bits) of the digital data. In this way, an interpolation gray level can be further obtained by the oscillating voltage technique between interpolation gray levels obtained by the resistance division technique.

Thus, the invention described herein makes possible the advantage of providing a driving circuit for a display device realizing 256 or more gray levels by utilizing advantages of the resistance division technique and the oscillating voltage technique.

These and other advantages of the present invention will become apparent to those skilled in the art upon reading and understanding the following detailed description with reference to the accompanying figures.

BRIEF DESCRIPTION OF THE DRAWINGS

FIG. 30 shows Table 1 which is a logic table defining the relationships between certain data bits input into logic circuit 41 and the control signals output by logic circuit 41.

FIG. 31 shows Table 3 which is a logic table defining the relationships between certain data bits input into logic circuit 81 and the control signals output by logic circuit 81.

DESCRIPTION OF THE PREFERRED EMBODIMENTS

The present invention will be described by way of examples with reference to the accompanying drawings.

EXAMPLE 1

Figure 1:
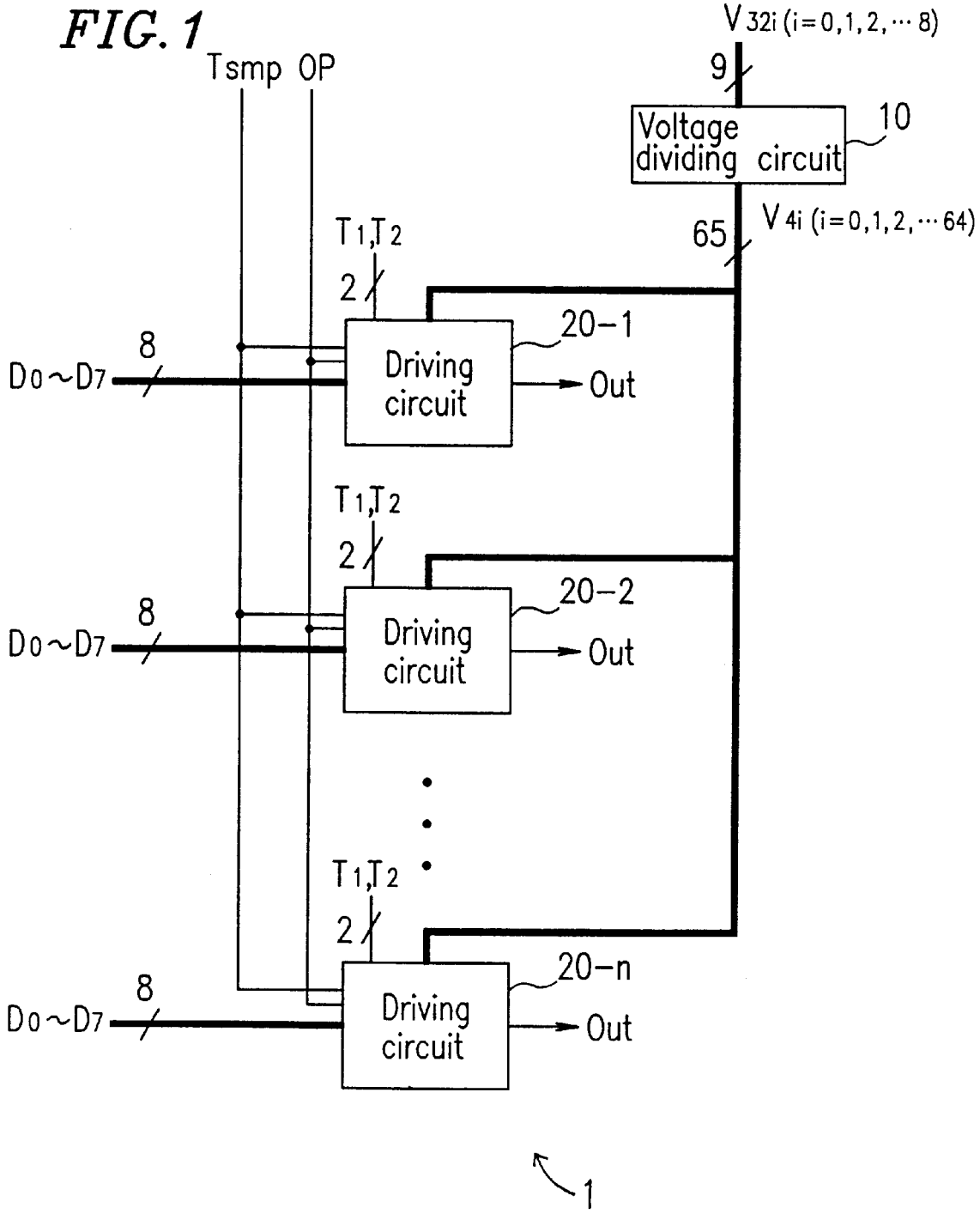
FIG. 1 is a block diagram of an 8-bit digital driver according to the present invention.

FIG. 1 shows a configuration of an 8-bit digital driver 1 according to the present invention. The driver 1 includes a voltage dividing circuit 10 and n driving circuits 20-1 to 20-n (n is a positive integer).

Figure 2A:
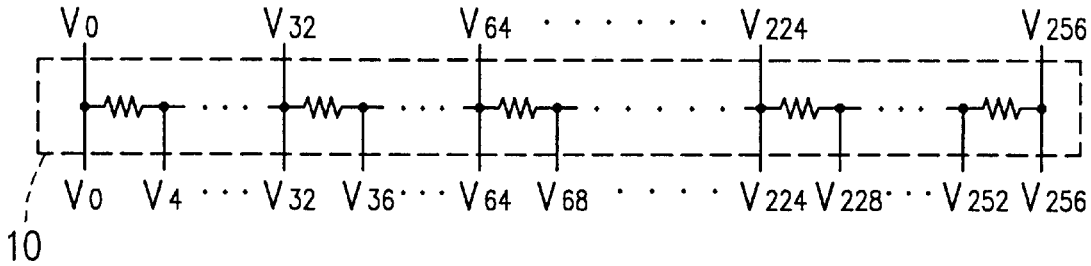
FIG. 2A shows a configuration of a voltage dividing circuit shown in FIG. 1.

As shown in FIG. 2A, the voltage dividing circuit 10 divides nine gray level voltages $V_0$, $V_{32}$, $V_{64}$, . . . , $V_{224}$, and $V_{256}$ supplied externally to generate 56 interpolation voltages, and outputs a total of 65 voltages $V_0$, $V_4$, $V_8$, . . . , $V_{252}$, and $V_{256}$ including the gray level voltages and the interpolation voltages. Hereinbelow, the nine gray level voltages are denoted by $V_{32i}$ (i=0, 1, 2, . . . , 8), and the 65 voltages output from the voltage dividing circuit 10 are denoted by $V_{4i}$ (i=0, 1, 2, . . . , 64).

In the example shown in FIG. 1, the voltage dividing circuit 10 is shared by the n driving circuits 20-1 to 20-n. The size of the driver is reduced by sharing the voltage dividing circuit as in this example. However, the present invention is not restricted to this configuration, but a separate voltage dividing circuit may be provided for each of the n driving circuits 20-1 to 20-n.

Each of the driving circuits 20-1 to 20-n receives signals $T_1$ and $T_2$, together with the voltage $V_{4i}$ (i=0, 1, 2, . . . , 64) supplied from the voltage dividing circuit 10, and outputs an output voltage Out corresponding to input digital data to a data line (not shown) based on the voltage $V_{4i}$ (i=0, 1, 2, . . . , 64) and the signals $T_1$ and $T_2$. For example, when the digital data is composed of eight bits, $2^8$ (=256) kinds of the output voltage Out are output. The data line is connected with corresponding pixels (not shown) during a period from the time when each of the driving circuits 20-1 to 20-n receives an output pulse OP until the time when it receives a next output pulse OP (hereinbelow, such a period is referred to as a "one output period", allowing the pixels to be charged based on the output voltage Out. In this way, a display with $2^8$ (=256) gray levels is realized.

FIG. 2A shows a configuration of the voltage dividing circuit 10 shown in FIG. 1. The nine gray level voltages $V_{32i}$ (i=0, 1, 2, . . . , 8) are input into the voltage dividing circuit 10. The voltage dividing circuit 10 has eight resistances R between every two adjacent gray level voltages $V_{32i}$ (i=0, 1, 2, . . . , 8), and divides the gray level voltages $V_{32i}$ (i=0, 1, 2, . . . , 8) by use of the resistances R to generate 56 interpolation voltages. Thus, a total of 65 voltages $V_{4i}$ (i=0, 1, 2, . . . , 64) including the gray level voltages and the interpolation voltages are output from the voltage dividing circuit 10. The total number of the gray level voltages and the interpolation voltages is designed to be smaller than a half of the number of output voltages determined by the number of bits of digital data operated by the driver.

Figure 2B:
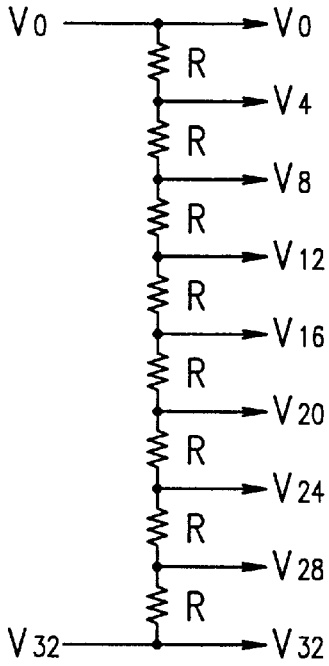
FIG. 2B is a partial view of the voltage dividing circuit of FIG. 2A.

FIG. 2B shows an array of the resistances R connected in series between the gray level voltages $V_0$ and $V_{32}$ shown in FIG. 2A. Such an array of eight resistances R is also provided between any of the other gray level voltages.

Figure 3A:
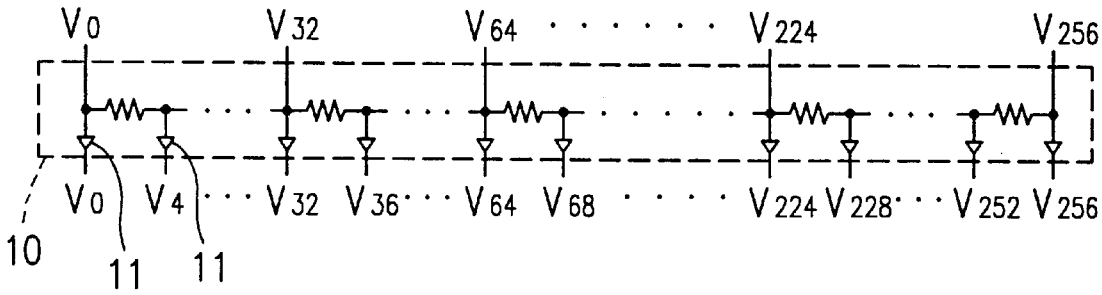
FIG. 3A shows another configuration of the voltage dividing circuit shown in FIG. 1.

FIG. 3A shows another configuration of the voltage dividing circuit 10, where an impedance converter 11 is provided for each output of the voltage dividing circuit 10. The impedance converter 11 converts a high input impedance into a low output impedance. According to the impedance converter 11, an input voltage is output without any change, and a large current can be obtained from the output side while a current hardly flows into the input side. A voltage follower, for example, is used as the impedance converter 11.

The voltage dividing circuit 10 provided with the impedance converters 11 can drive a large load. Therefore, the voltage dividing circuit 10 is preferably provided with the impedance converter 11 for each output when it is connected with the plurality of driving circuits 20-1 to 20-n as in the illustrated example.

Figure 3B:
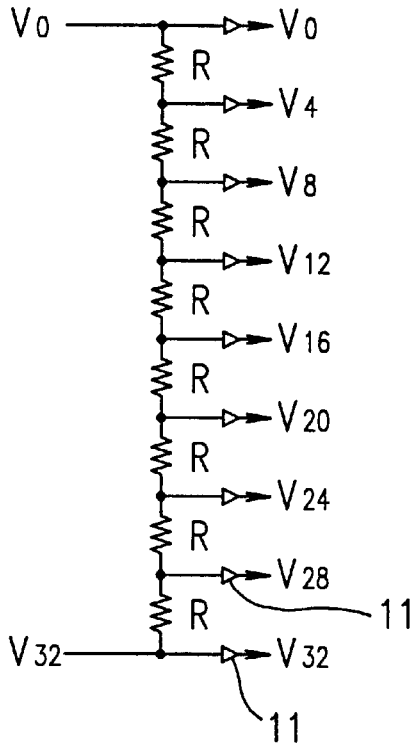
FIG. 3B is a partial view of the voltage dividing circuit of FIG. 3A.

FIG. 3B shows an array of the resistances R connected in series between the gray level voltages $V_0$ and $V_{32}$ shown in FIG. 3A. Such an array of 8 resistances R is also provided between any of the other gray level voltages.

Figure 4:
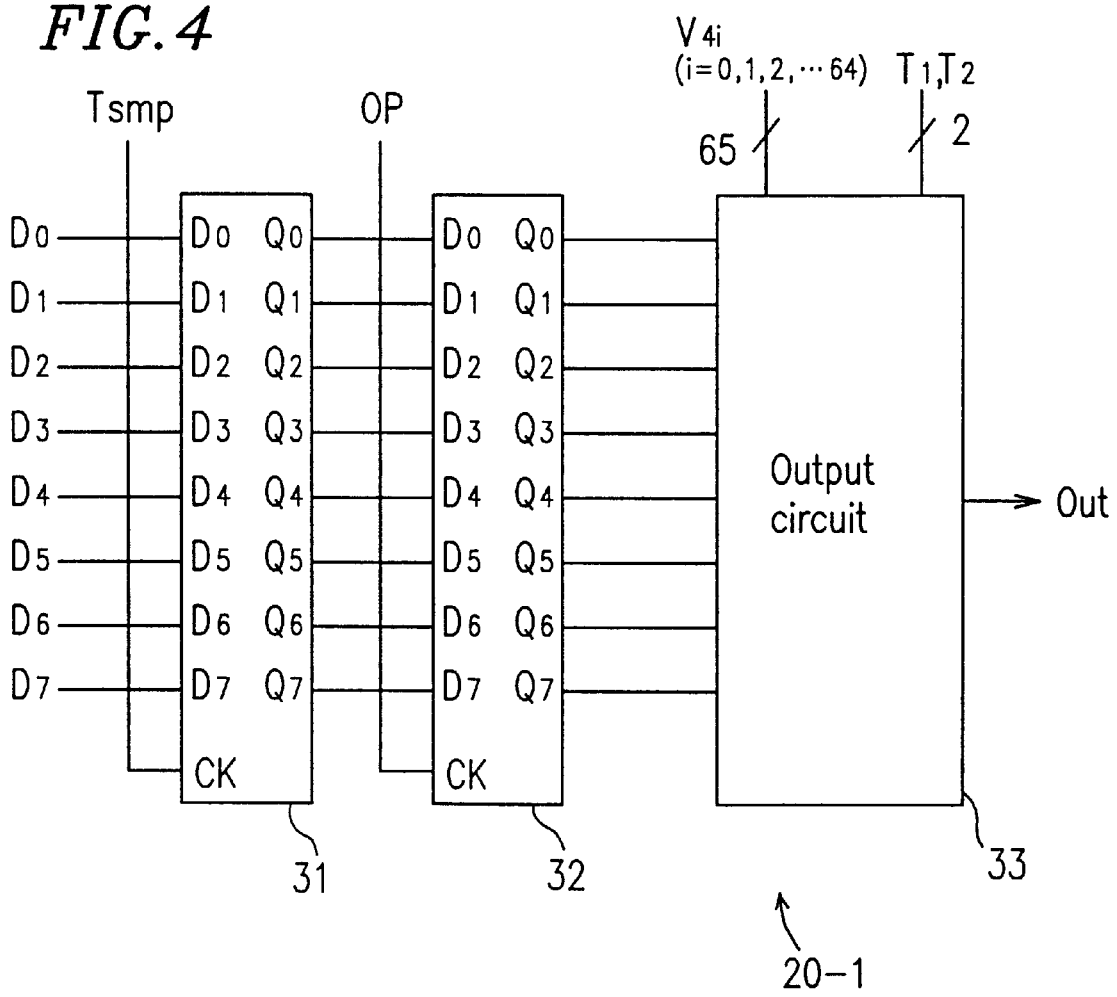
FIG. 4 is a block diagram of a driving circuit shown in FIG. 1.

FIG. 4 shows a configuration of the driving circuit 20-1 shown in FIG. 1, which corresponds to one output of the 8-bit digital driver 1.

The driving circuit 20-1 includes a sampling memory 31, a hold memory 32, and an output circuit 33. In response to a rising edge of a sampling pulse $T_{smp}$, 8-bit digital data $D_0$ to $D_7$ are stored in the sampling memory 31. The stored data is then transferred in response to a rising edge of an output pulse OP to the hold memory 32 to be held therein. The output circuit 33 outputs an output voltage Out corresponding to the values of the digital data held in the hold memory 32 based on the voltages $V_{4i}$ (i=0, 1, 2, . . . , 64) supplied from the voltage dividing circuit 10 and the signals $T_1$ and $T_2$.

The other driving circuits 20-2 to 20-n shown in FIG. 1 have the same configuration as the driving circuit 20-1 described above.

Figure 5:
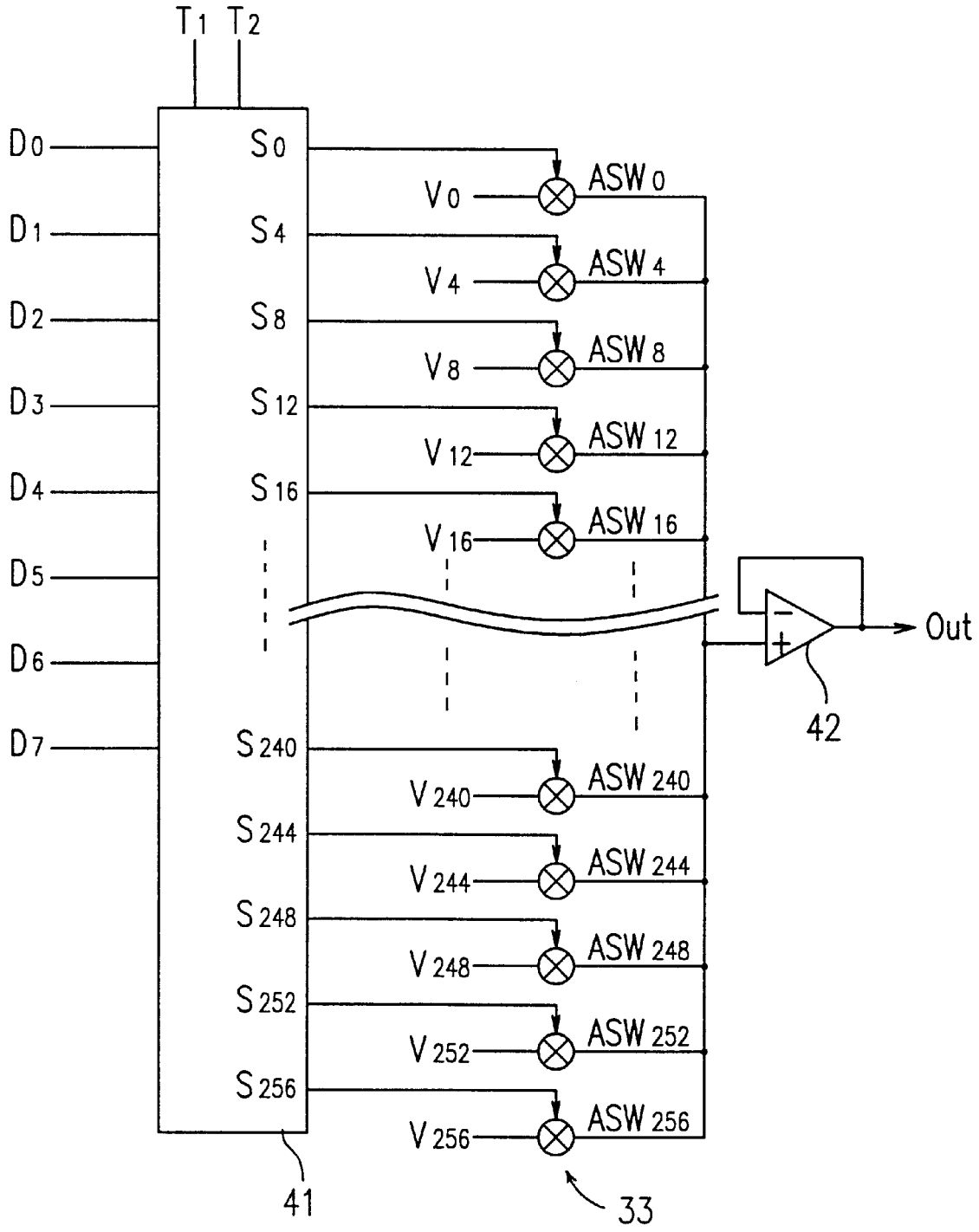
FIG. 5 is a block diagram of an output circuit of the driving circuit of FIG. 4.

FIG. 5 shows a configuration of the output circuit 33 shown in FIG. 4. The output circuit 33 includes a logic circuit 41, 65 analog switches (analog gates) $ASW_0$, $ASW_4$, $ASW_8$, . . . , $ASW_{256}$, and an impedance converter 42.

The logic circuit 41 operates in accordance with a logic defined in Table 1 (FIG. 30) and Table 2 (below). Table 1 is a logic table defining the relationships between the values of the six most significant bits $D_7$ to $D_2$ of the digital data input into the logic circuit 41 and the values of control signals $S_0$, $S_4$, $S_8$, . . . ,$S_{256}$ output from the logic circuit 41.

In Table 1, code "T" indicates that the value of the control signal is equal to the value of a parameter T, and code "T bar" indicates that the value of the control signal is equal to the inverted value of the parameter T. The parameter is defined by Table 2 below as will be described later. The value of the parameter is "0" or "1". In Table 1, each blank indicates that the value of the control signal is "0".

The control signals $S_0$, $S_4$, $S_8$, . . . , $S_{256}$ are supplied to the analog switches (analog gates) $ASW_0$, $ASW_4$, $ASW_8$, . . . , $ASW_{256}$, respectively. When the value of the control signal is "0" (inactive), the corresponding analog switch is turned off. When the value of the control signal is "1" (active), the corresponding analog switch is turned on.

The analog switches $ASW_0$, $ASW_4$, $ASW_8$, . . . , $ASW_{256}$ also receive the voltages $V_0$, $V_4$, $V_8$, . . . , $V_{256}$ from the voltage dividing circuit 10, respectively. Each of the analog switches is configured to output the input voltage without any change when it is turned on.

The voltage output from any of the analog switches is supplied to a data line (not shown) as the output voltage Out via the impedance converter 42. The function and operation of the impedance converter 42 are the same as those of the impedance converters 11 described above. The description thereof is therefore omitted here. The impedance converter 42 may be omitted when the load to be driven by the driver is small.

Table 2 below is a logic table defining the relationship between the values of the two least significant bits $D_1$ and $D_0$ input into the logic circuit and the parameter T.

TABLE 2

| $D_1$ | $D_0$ | T |
|---|---|---|
| 0 | 0 | I |
| 0 | 1 | $T_1$ |
| 1 | 0 | $T_2$ |
| 1 | 1 | $\overline{T_1}$ |

That is, the parameter T is defined by the logic equation represented by Expression 2 below:

$$T=\bar{D}_1\cdot\bar{D}_0+\bar{D}_1\cdot D_0\cdot T_1+D_1\cdot\bar{D}_0\cdot T_2+D_1\cdot D_0\cdot\bar{T}_1 \quad (2)$$

The relationship between the control signals $S_0$, $S_4$, $S_8$, . . . , $S_{256}$ and the parameter T is represented by the logic equations represented by Expression (3) below:

$$\begin{cases} S_0 = \{0\}T \\ S_4 = \{0\}\overline{T} + \{4\}T \\ S_8 = \{4\}\overline{T} + \{12\}T \\ \quad\vdots \\ S_{252} = \{248\}\overline{T} + \{252\}T \\ S_{256} = \{252\}\overline{T} \end{cases} \quad (3)$$

wherein $\{N\}$ $$N = 2^5\cdot D_7 + 2^4\cdot D_6 + 2^3\cdot D_5 + 2^3\cdot D_5 + 2^2\cdot D_4 + 2\cdot D_3 + D_2$$

Figure 6:
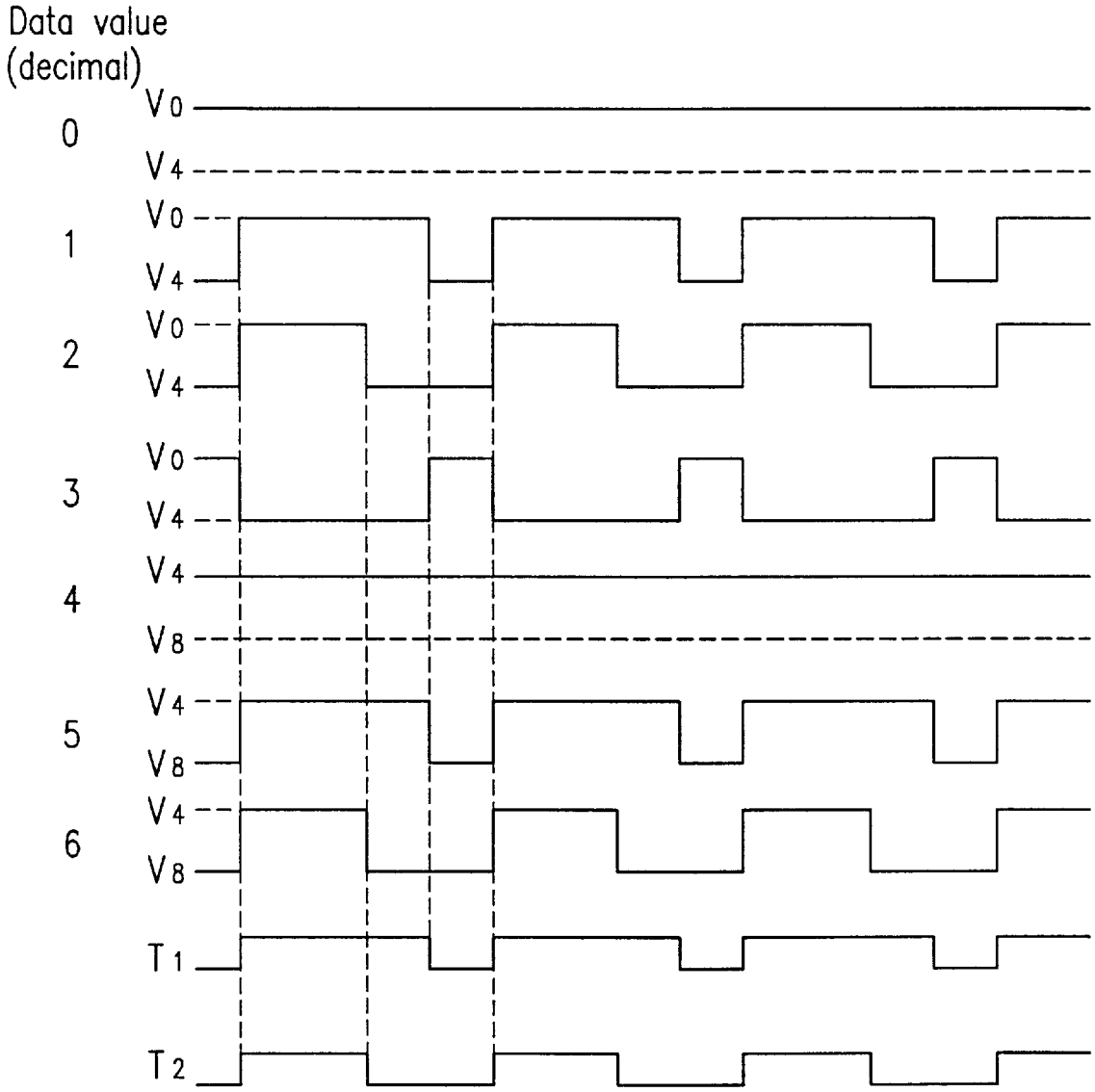
FIG. 6 shows waveforms of oscillating signals and output voltages.

FIG. 6 shows waveforms of the signals $T_1$ and $T_2$ and the output voltage Out obtained when the values of the digital data correspond to 0 to 6 in the decimal notation.

The signals $T_1$ and $T_2$ are oscillating signals which oscillate during one output period. In the example shown in FIG. 6, the signal $T_1$ is high for three quarters of one period, while the signal $T_2$ is high for a half of one period. The signals $T_1$ and $T_2$ are designed so that the high-level periods of the signals $T_1$ and $T_2$ overlap each other.

The output voltage Out is either one of the voltages $V_{4i}$ (i=0, 1, 2, . . . , 64) output from the voltage dividing circuit 10 or an oscillating voltage which oscillates between two adjacent voltages output from the voltage dividing circuit 10 at a duty ratio obtained based on the signals $T_1$ and $T_2$.

When the values of the digital data correspond to any of 0 to 3 in the decimal notation, at least one of the voltages $V_0$ and $V_4$ is used to generate the output voltage Out. The voltage $V_0$ is one of the nine gray level voltages input into the digital driver 1, while the voltage $V_4$ is one of the seven interpolation voltages obtained by dividing the potential difference between the gray level voltages $V_0$ and $V_{32}$ by the voltage dividing circuit 10.

When the values of the digital data correspond to any of 4 to 6 in the decimal notation, at least one of the voltages $V_4$ and $V_8$ is used to generate the output voltage Out. Each of the voltages $V_4$ and $V_8$ is one of the seven interpolation voltages obtained by dividing the potential difference between the gray level voltages $V_0$ and $V_{32}$ by the voltage dividing circuit 10.

In this way, at least one of the adjacent two voltages used to generate the output voltage Out is an interpolation voltage obtained by the voltage dividing circuit 10. This use of an interpolation voltage greatly reduces the amplitude of the output voltage Out compared with the conventional technique. Thus, the shortcoming of the oscillating voltage technique described above is overcome.

The waveforms of the oscillating signals input into the digital driver 1 are not restricted to those shown in FIG. 6. For example, signals $T_0$ and $T_1$ shown in FIG. 7 may be used instead of the signals $T_1$ and $T_2$.

Figure 7:
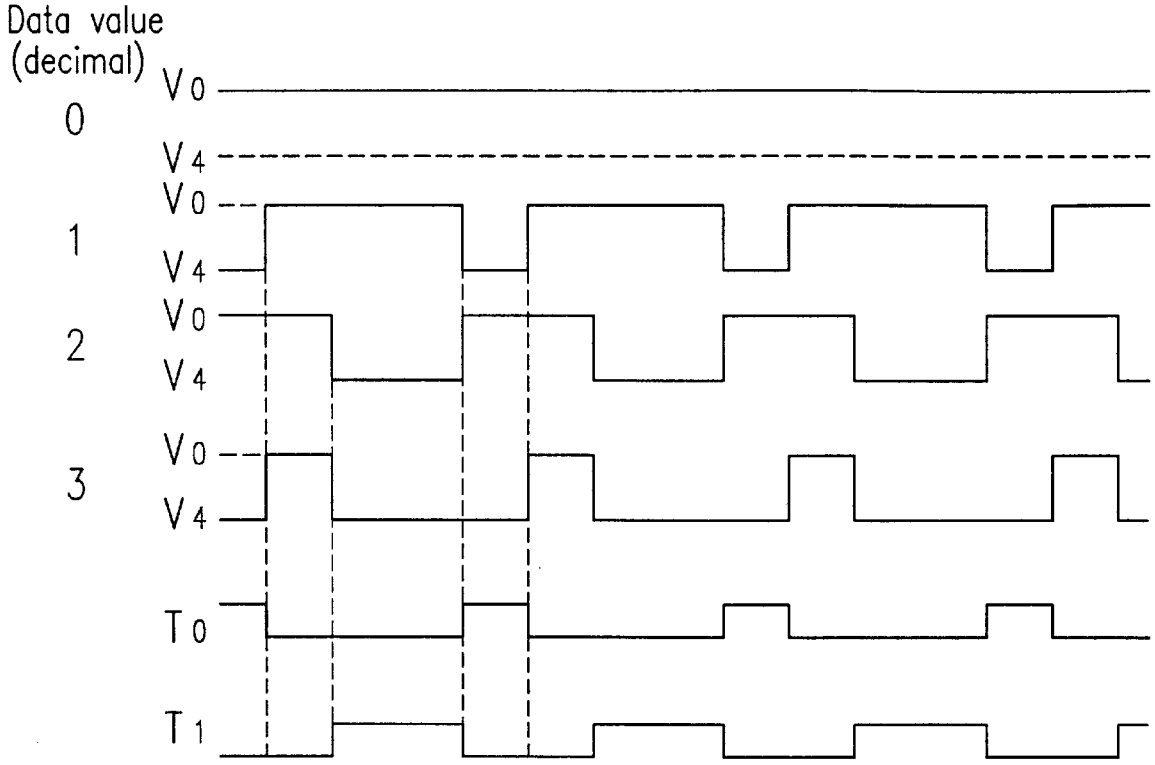
FIG. 7 shows waveforms of oscillating signals and output voltages.

FIG. 7 shows waveforms of the signals $T_0$ and $T_1$ and the output voltage Out obtained when the values of the digital data correspond to 0 to 3 in the decimal notation.

The signals $T_0$ and $T_1$ are oscillating signals which oscillate during one output period. In the example shown in FIG. 7, the signal $T_0$ is high for one quarter of one period, while the signal $T_1$ is high for a half of one period. The signals $T_0$ and $T_1$ are designed so that the high-level periods of the signals $T_0$ and $T_1$ do not overlap each other.

When the signals $T_0$ and $T_1$ shown in FIG. 7 are used instead of the signals $T_1$ and $T_2$, the parameter T is defined by the logic equation represented by Expression (4) below:

$$T=\overline{D_0\cdot T_0+D_1\cdot T_1} \quad (4)$$

wherein $D_1$ and $D_0$ denote the two least significant bits of digital data.

The logic equation represented by Expression (4) is simpler than that represented by Expression (2). By using the signals $T_0$ and $T_1$, therefore, the logic equation for the parameter T, and thus the logic circuit 41 which realizes the logic equation for the parameter T, can be simplified.

EXAMPLE 2

Figure 8:
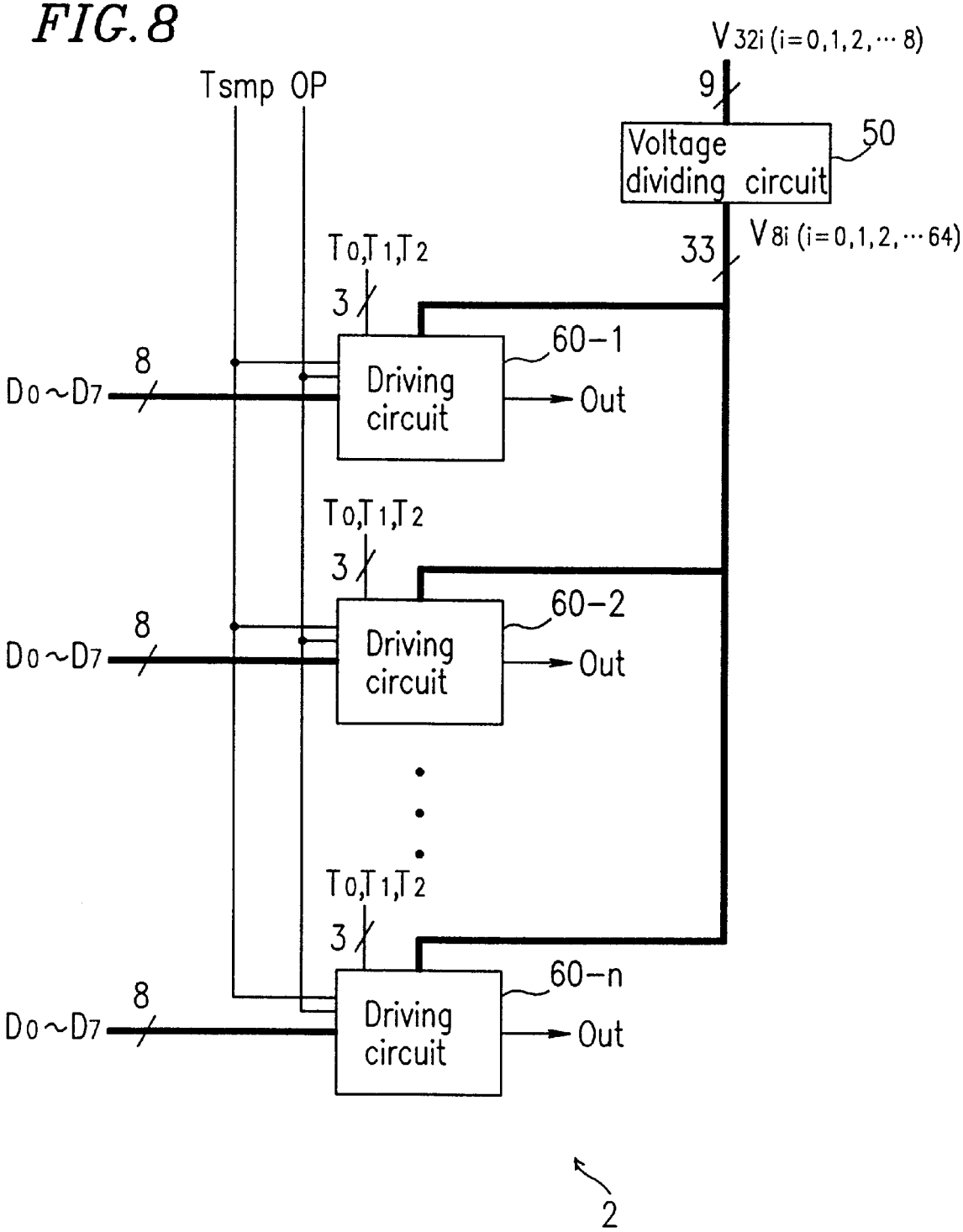
FIG. 8 is a block diagram of another 8-bit digital driver according to the present invention.

FIG. 8 shows a configuration of an 8-bit digital driver 2 according to the present invention. The driver 2 includes a voltage dividing circuit 50 and n driving circuits 60-1 to 60-n (n is a positive integer). The driver 2 generates oscillating voltages using the three least significant bits of digital data.

Figure 9A:
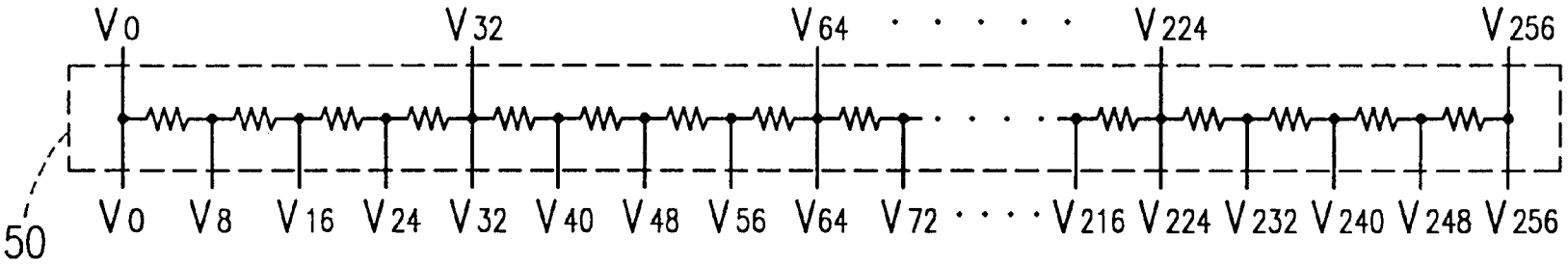
FIG. 9A shows a configuration of a voltage dividing circuit shown in FIG. 8.

As shown in FIG. 9A, the voltage dividing circuit 50 divides nine gray level voltages $V_0$, $V_{32}$, $V_{64}$, . . . , $V_{224}$, and $V_{256}$ supplied externally to generate 24 interpolation voltages, and outputs a total of 33 voltages $V_0$, $V_8$, $V_{16}$, . . . , $V_{248}$, and $V_{256}$ including the gray level voltages and the interpolation voltages. Hereinbelow, the nine gray level voltages are denoted by $V_{32i}$ (i=0, 1, 2, . . . , 8), and the 33 voltages output from the voltage dividing circuit 50 are denoted by $V_{8i}$ (i=0, 1, 2, . . . , 32).

Each of the driving circuits 60-1 to 60-n receives signals $T_0$, $T_1$ and $T_2$, together with the voltage $V_{8i}$ (i=0, 1, 2, . . . , 32) supplied from the voltage dividing circuit 50.

FIG. 9A shows a configuration of the voltage dividing circuit 50 shown in FIG. 8. The voltage dividing circuit 50 has four resistances R between every two adjacent gray level voltages $V_{32i}$ (i=0, 1, 2, . . . , 8). Since the number of resistances R in the voltage dividing circuit 50 is a half of that in the voltage dividing circuit 10 in Example 1, the configuration of the voltage dividing circuit 50 can be simplified compared with that of the voltage dividing circuit 10.

Figure 9B:
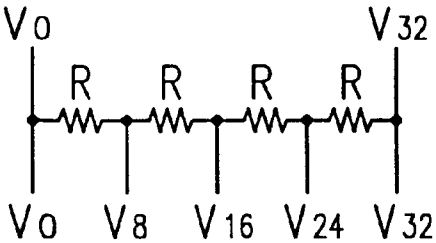
FIG. 9B is a partial view of the voltage dividing circuit of FIG. 9A.

FIG. 9B shows an array of the resistances R connected in series between the gray level voltages $V_0$ and $V_{32}$ shown in FIG. 9A. Such an array of four resistances R is also provided between any of the other gray level voltages.

Figure 10A:
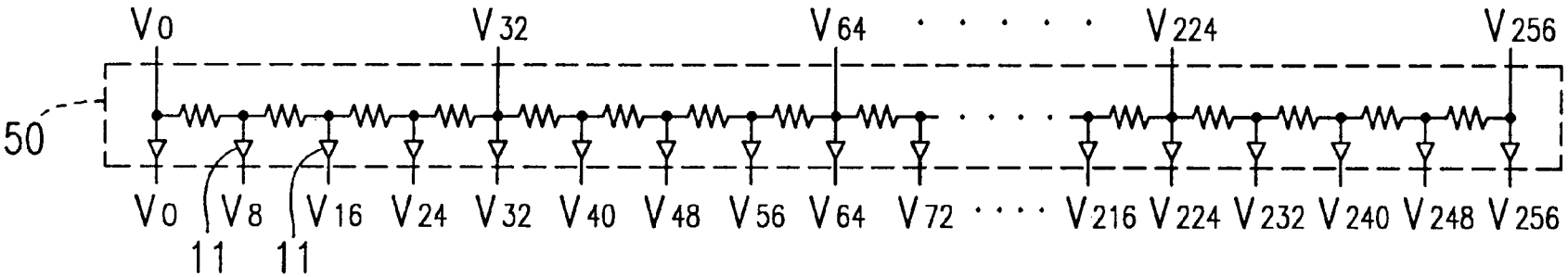
FIG. 10A shows another configuration of the voltage dividing circuit shown in FIG. 8.
Figure 10B:
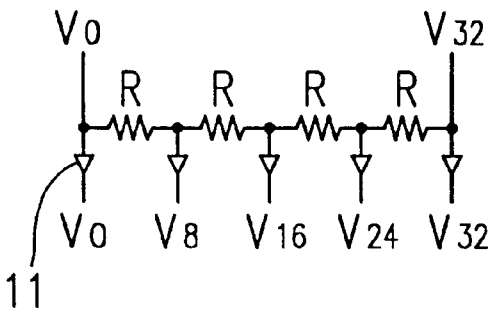
FIG. 10B is a partial view of the voltage dividing circuit of FIG. 10A.

An impedance converter 11 may be provided for each output of the voltage dividing circuit 50 as shown in FIGS. 10A and 10B. The voltage dividing circuit 50 with the impedance converters 11 can drive a large load.

Figure 11:
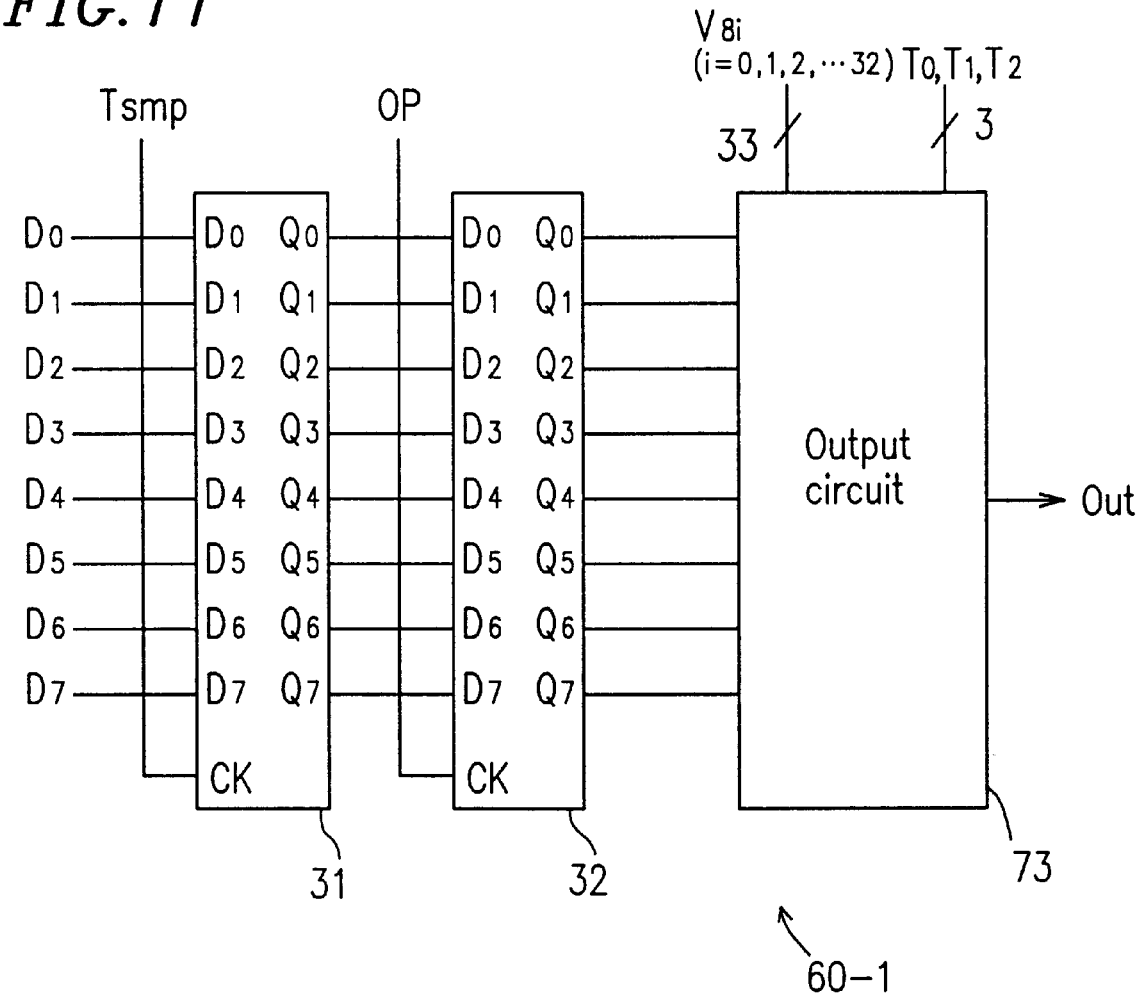
FIG. 11 is a block diagram of a driving circuit shown in FIG. 8.

FIG. 11 shows a configuration of the driving circuit 60-1 shown in FIG. 8, which corresponds to one output of the 8-bit digital driver 2. The configuration of the driving circuit 60-1 is the same as that of the driving circuit 20-1 except for an output circuit 73. The same components are denoted by the same reference numerals, and the description thereof is omitted. The other driving circuits 60-2 to 60-n shown in FIG. 8 have the same configuration as the driving circuit 60-1 described above.

Figure 12:
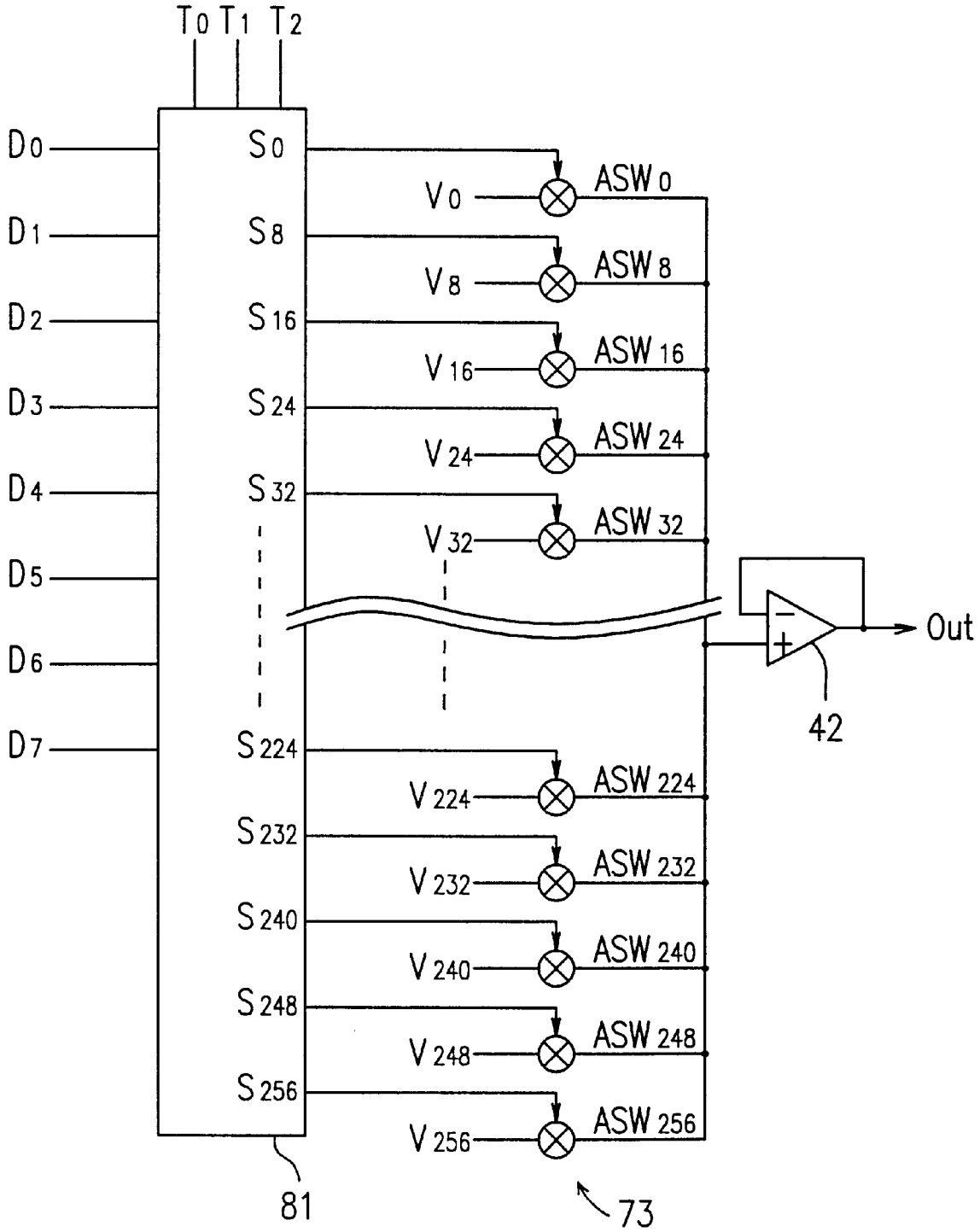
FIG. 12 is a block diagram of an output circuit of the driving circuit of FIG. 11.

FIG. 12 shows a configuration of the output circuit 73 shown in FIG. 11. The output circuit 73 includes a logic circuit 81, 33 analog switches (analog gates) $ASW_0$, $ASW_8$, $ASW_{16}$, . . . , $ASW_{256}$, and an impedance converter 42. The number of analog switches in the output circuit 73 is about a half of that in the output circuit 33 in Example 1. With the decreased number of analog switches, the configuration of the output circuit 73 is simplified compared with that of the output circuit 33.

The logic circuit 81 operates in accordance with a logic defined in Table 3 (FIG. 31) and Expression (5) below. Table 3 is a logic table defining the relationships between the values of the five most signigicant bits $D_7$ to $D_3$ of the digital data input into the logic circuit 81 and the values of control signals $S_0$, $S_8$, $S_{16}$, . . . , $S_{256}$ output from the logic circuit 81.

In Table 3, code "T" indicates that the value of the control signal is equal to the value of a parameter T, and code "T bar" indicates that the value of the control signal is equal to the inverted value of the parameter T. In Table 3, each blank indicates that the value of the control signal is "0".

The parameter T is defined by the logic equation represented by Expression (5) below in relation with the signals $T_0$ to $T_2$:

$$T=\overline{D_0 \cdot T_0+D_1 \cdot T_1+D_2 \cdot T_2} \quad (5)$$

Figure 13:
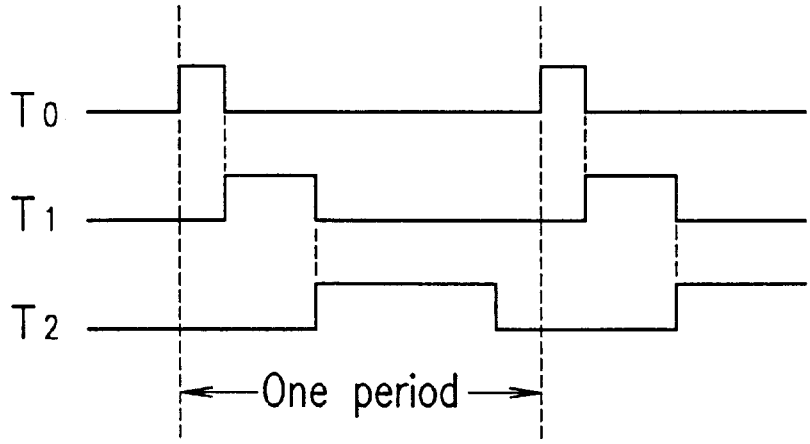
FIG. 13 shows waveforms of oscillating signals.

FIG. 13 shows waveforms of the signals $T_0$ to $T_2$ which are oscillating signals oscillating during one output period. In the example shown in FIG. 13, the signal $T_0$ is high for one-eighth of one period, the signal $T_1$ is high for one quarter of one period, and the signal $T_2$ is high for a half of one period. The signals $T_0$ to $T_2$ are designed so that the high-level periods of the signals $T_0$ to $T_2$ do not overlap one another.

As is observed from the comparison of Tables 1 and 3, the logic table of Table 3 is significantly simpler than the logic table of Table 1. More specifically, the logic table of Table 1 is composed of 64×64 points, while the logic table of Table 3 is composed of 32×32 points. The number of points in the logic table of Table 3 is therefore a quarter of that in the logic table of Table 1.

As is observed from the comparison of Expressions (4) and (5), the logic equation for the parameter T represented by Expression (5) has only one term added to the logic equation represented by Expression (4). It is easy to generate seven interpolation voltages by the oscillating voltage technique.

Thus, in the digital driver 2, the logic circuit can be significantly simplified compared with the digital driver 1. The digital driver 2 utilizes the advantages of the resistance division technique and the oscillating voltage technique more effectively. In the digital driver 2, the number of voltage supply lines extending from the voltage dividing circuit 50 to the respective driving circuits 60-1 to 60-n is about a half of that in the digital driver 1. This also reduces the chip area of the driver.

EXAMPLE 3

Figure 14:
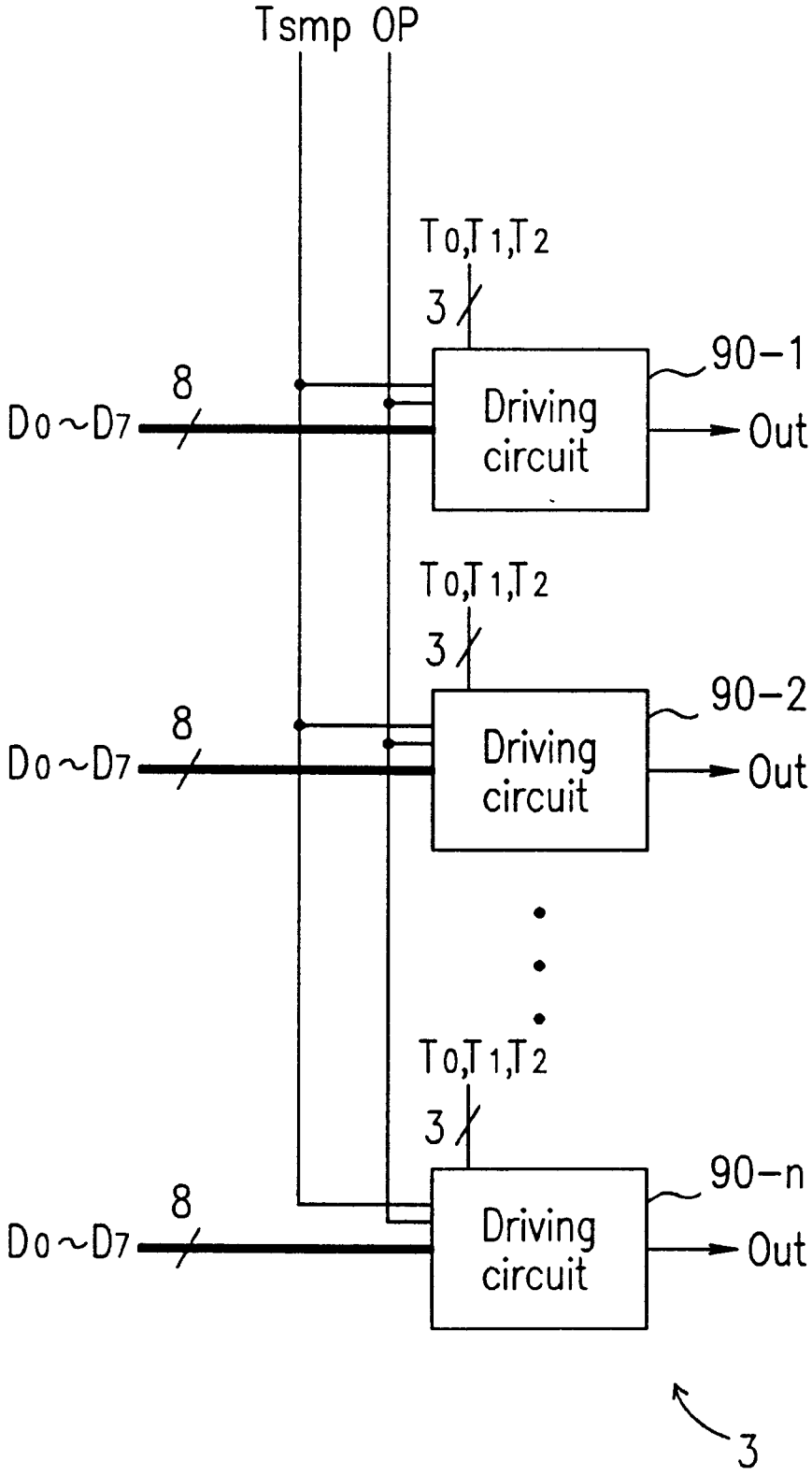
FIG. 14 is a block diagram of yet another 8-bit digital driver according to the present invention.

FIG. 14 shows a configuration of an 8-bit digital driver 3 according to the present invention. The driver 3 includes n driving circuits 90-1 to 90-n (n is a positive integer).

Each of the driving circuits 90-1 to 90-n receives signals $T_0$, $T_1$ and $T_2$ together with one of nine voltages $V_{32i}$ (i=0, 1, 2, . . . , 8).

Figure 15:
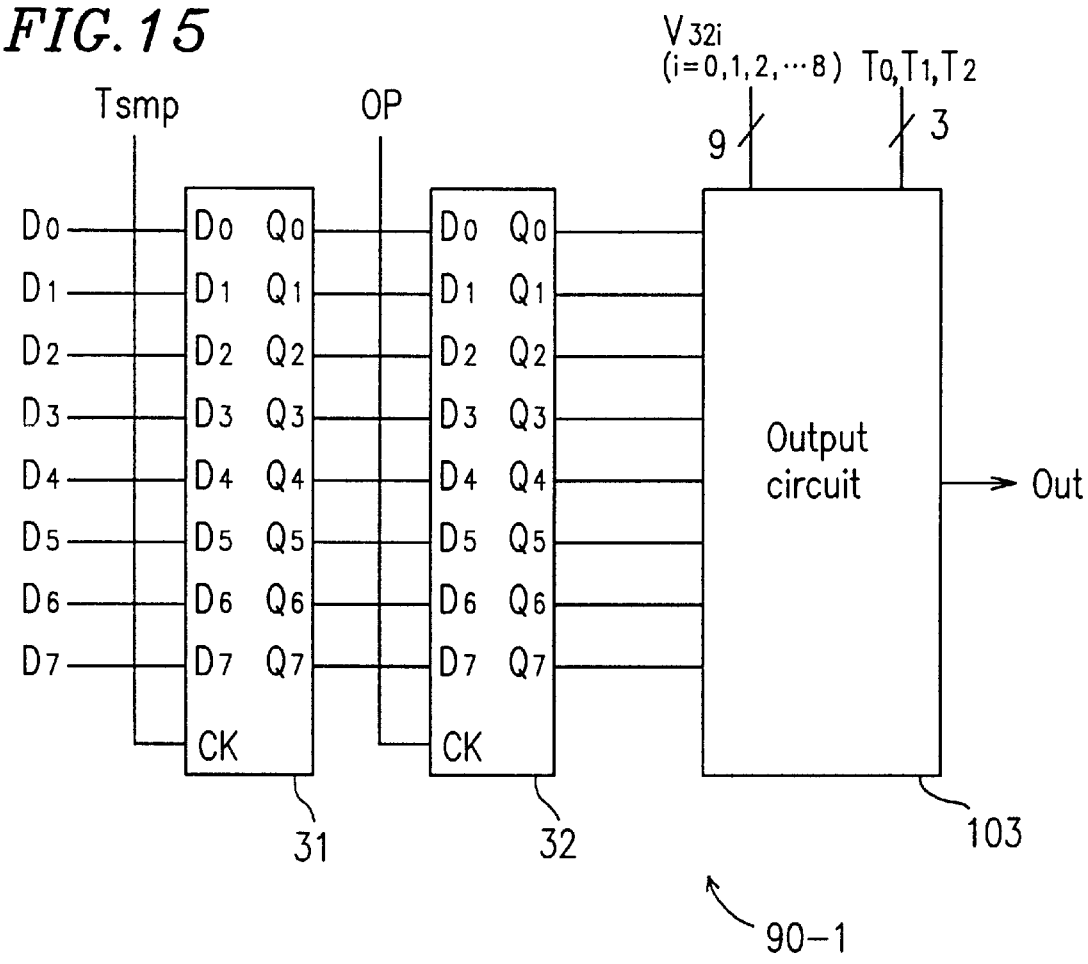
FIG. 15 is a block diagram of a driving circuit shown in FIG. 14.

FIG. 15 shows a configuration of the driving circuit 90-1 shown in FIG. 14, which corresponds to one output of the 8-bit digital driver 3. The configuration of the driving circuit 90-1 is the same as that of the driving circuit 20-1 except for an output circuit 103. The same components are denoted by the same reference numerals, and the description thereof is omitted. The other driving circuits 90-2 to 90-n shown in FIG. 14 have the same configuration as the driving circuit 90-1 described above.

Figure 16:
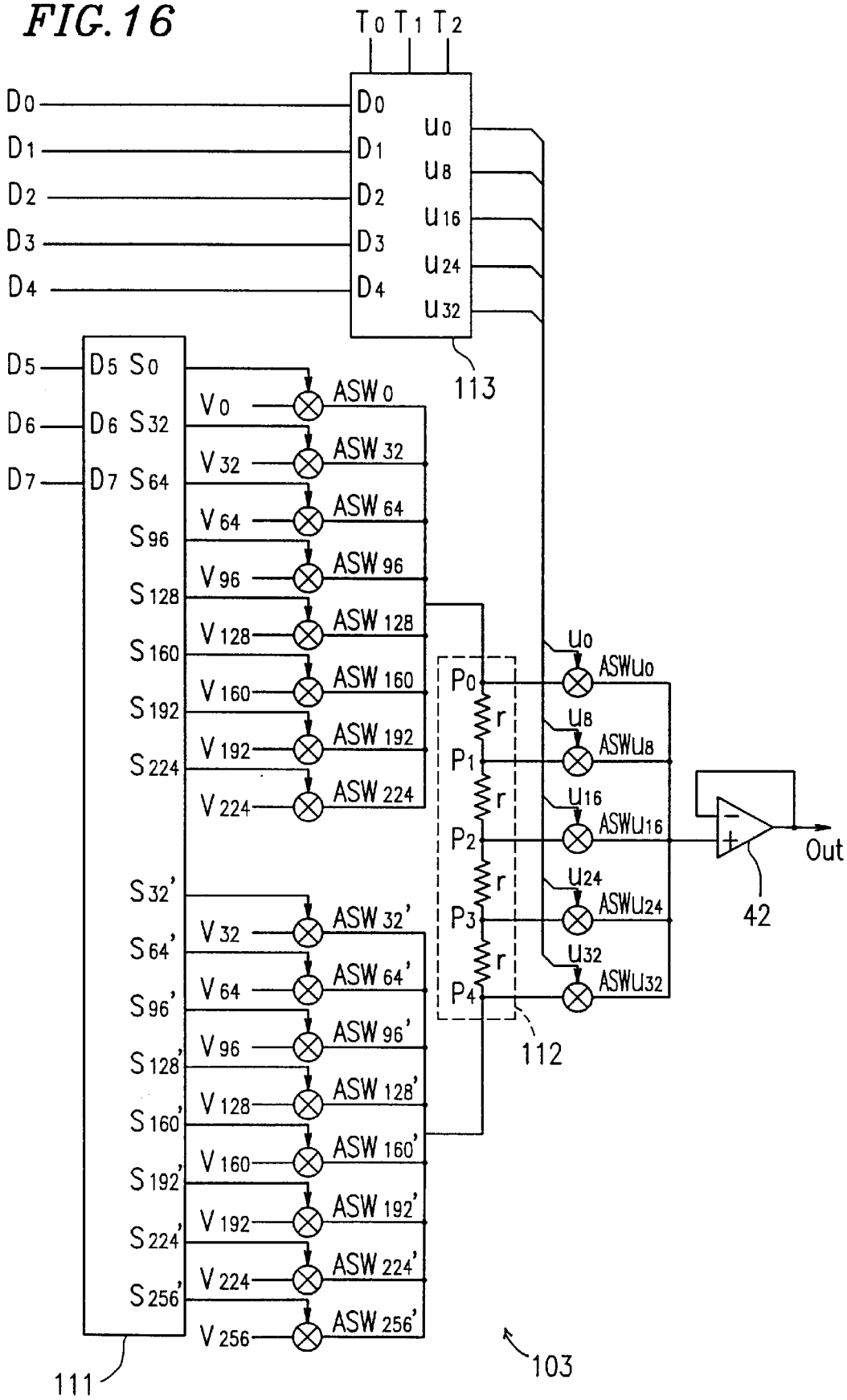
FIG. 16 is a block diagram of an output circuit of the driving circuit of FIG. 15.
Figure 17:
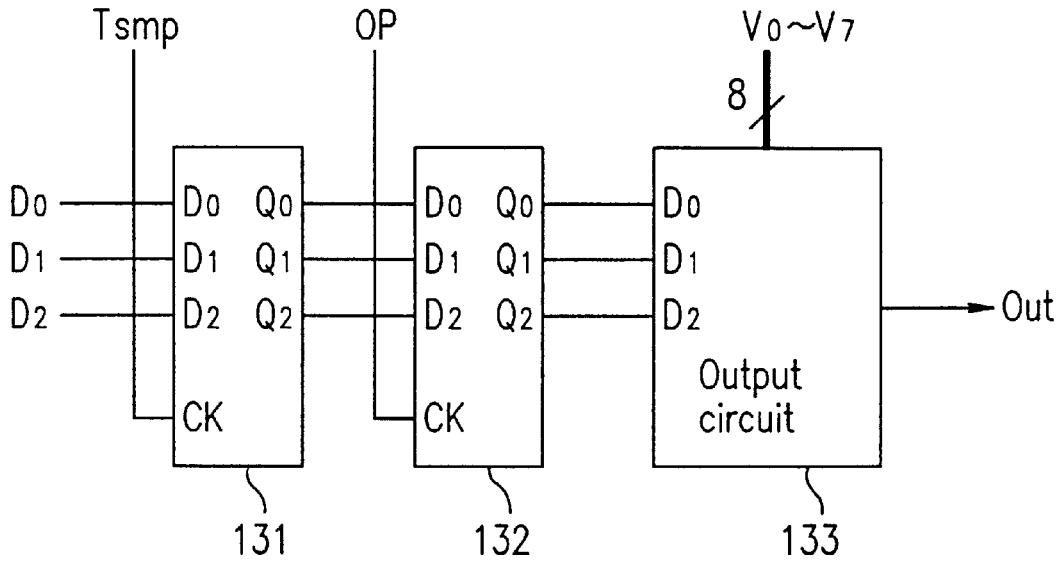
FIG. 17 PRIOR ART
FIG. 17 is a block diagram of a driving circuit of a conventional 3-bit digital driver.
Figure 18:
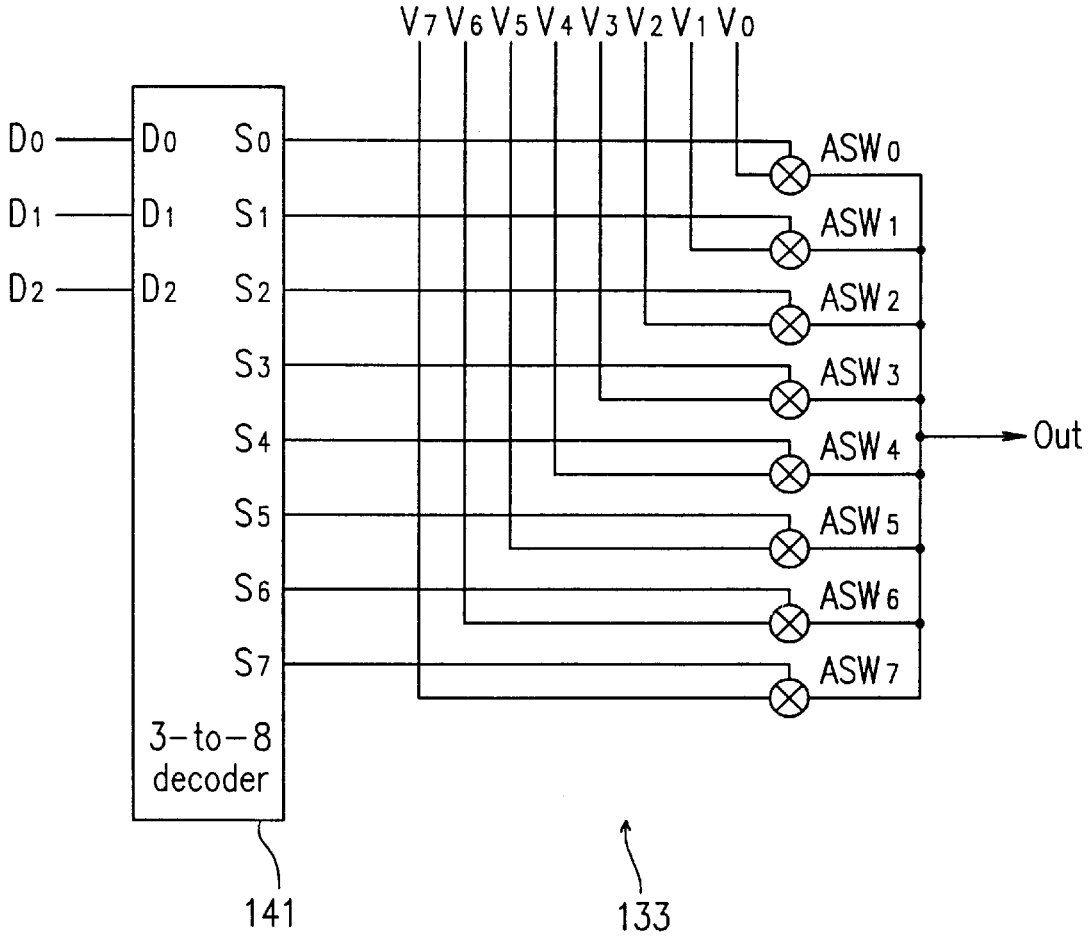
FIG. 18 PRIOR ART
FIG. 18 is a block diagram of an output circuit of the driving circuit of FIG. 17.
Figure 19:
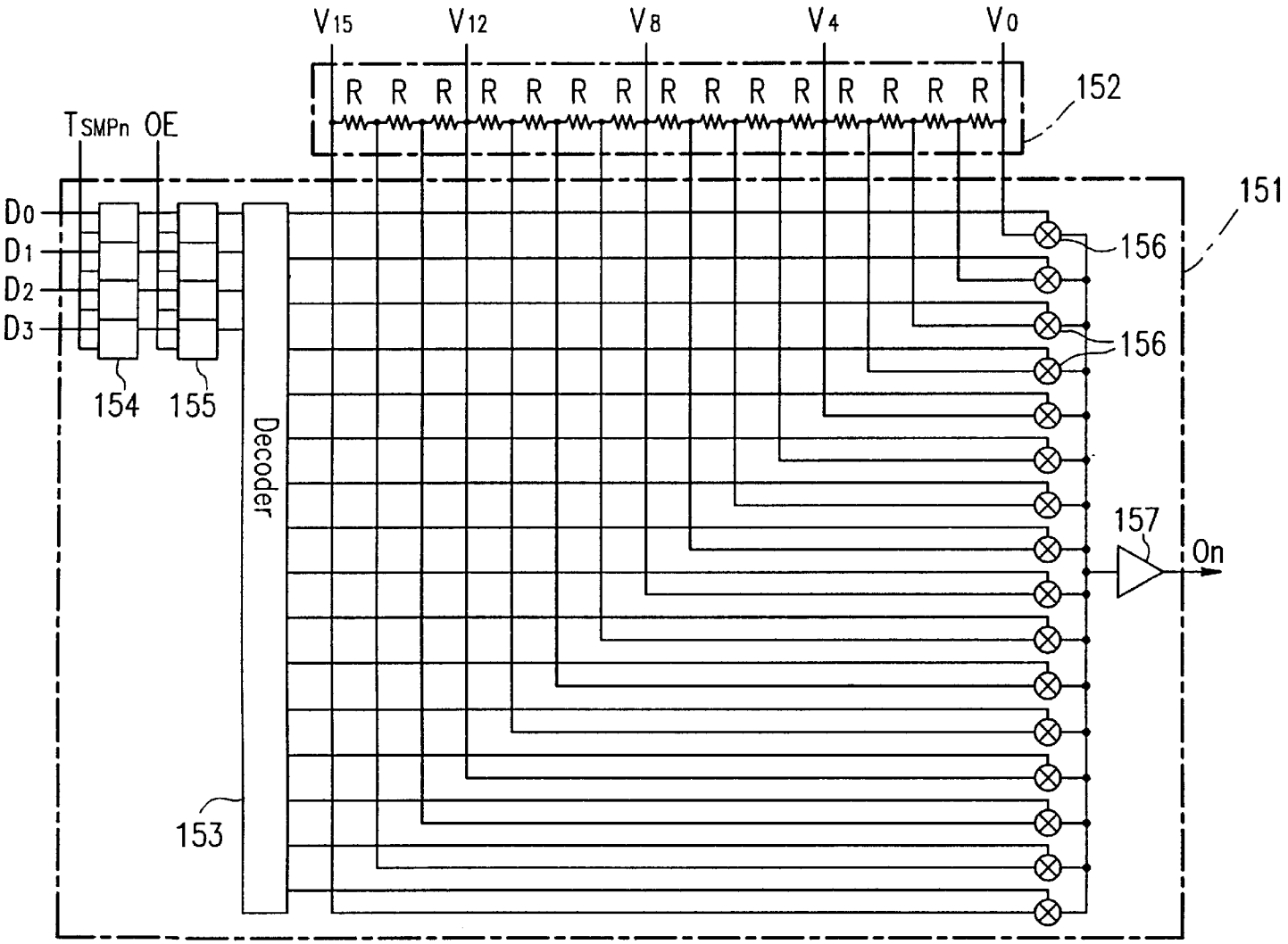
FIG. 19 PRIOR ART
FIG. 19 is a block diagram of a driving circuit and a voltage dividing circuit of a conventional 4-bit digital driver.
Figure 20A:
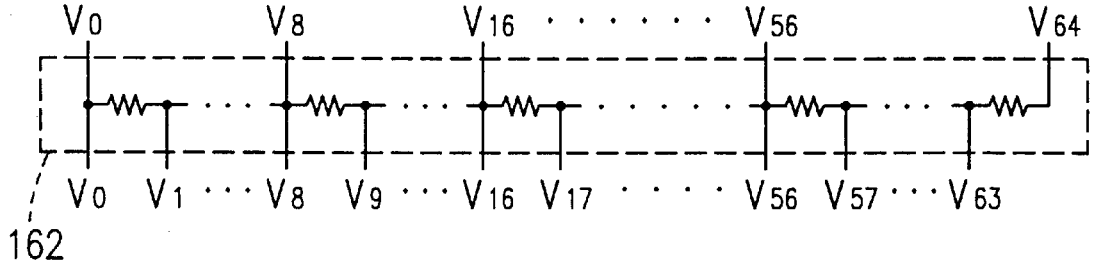
FIG. 20A PRIOR ART
FIG. 20A shows a configuration of a voltage dividing circuit of a 6-bit digital driver.
Figure 20B:
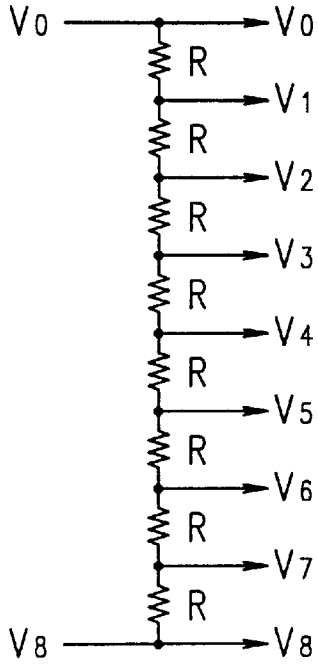
FIG. 20B PRIOR ART
FIG. 20B is a partial view of the voltage dividing circuit of FIG. 20A.
Figure 21:
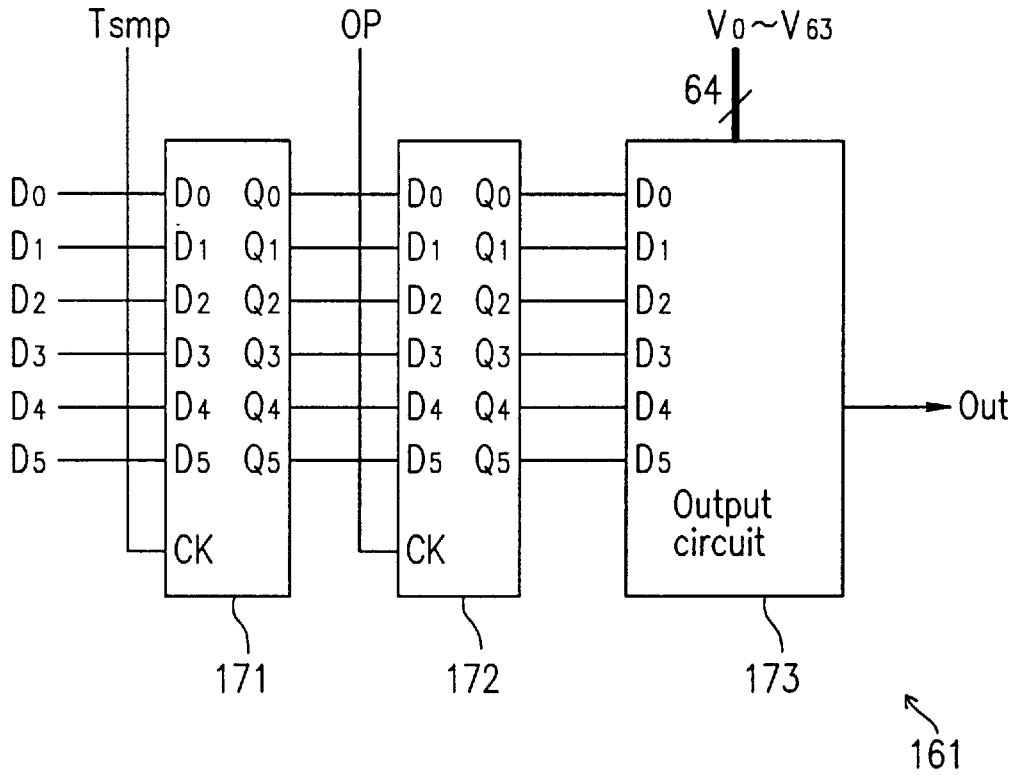
FIG. 21 PRIOR ART
FIG. 21 is a block diagram of a driving circuit of a conventional 6-bit digital driver.
Figure 22:
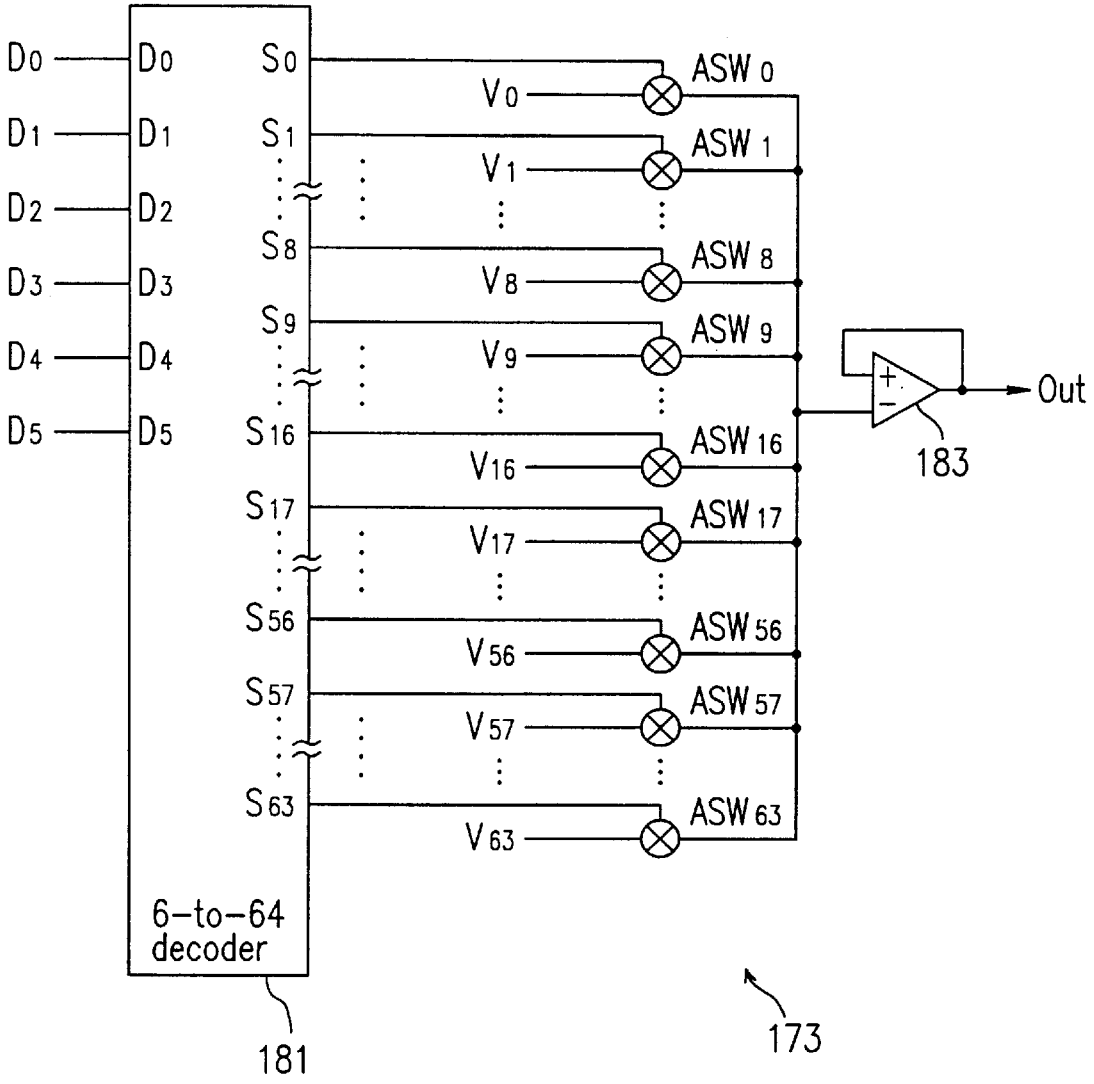
FIG.22 PRIOR ART
FIG. 22 is a block diagram of an output circuit of the driving circuit of FIG. 21.
Figure 23:
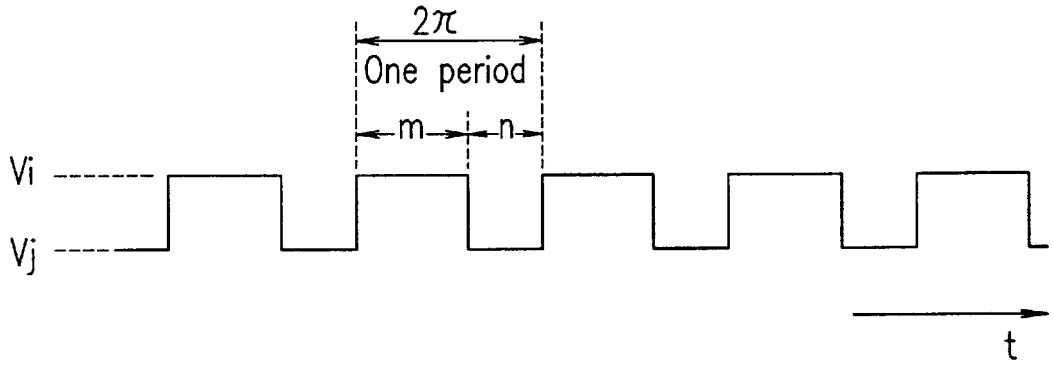
FIG. 23 PRIOR ART
FIG. 23 shows a waveform of a voltage oscillating between voltages $v_i$ and $v_j$ at a duty ratio of m:n.
Figure 24A:
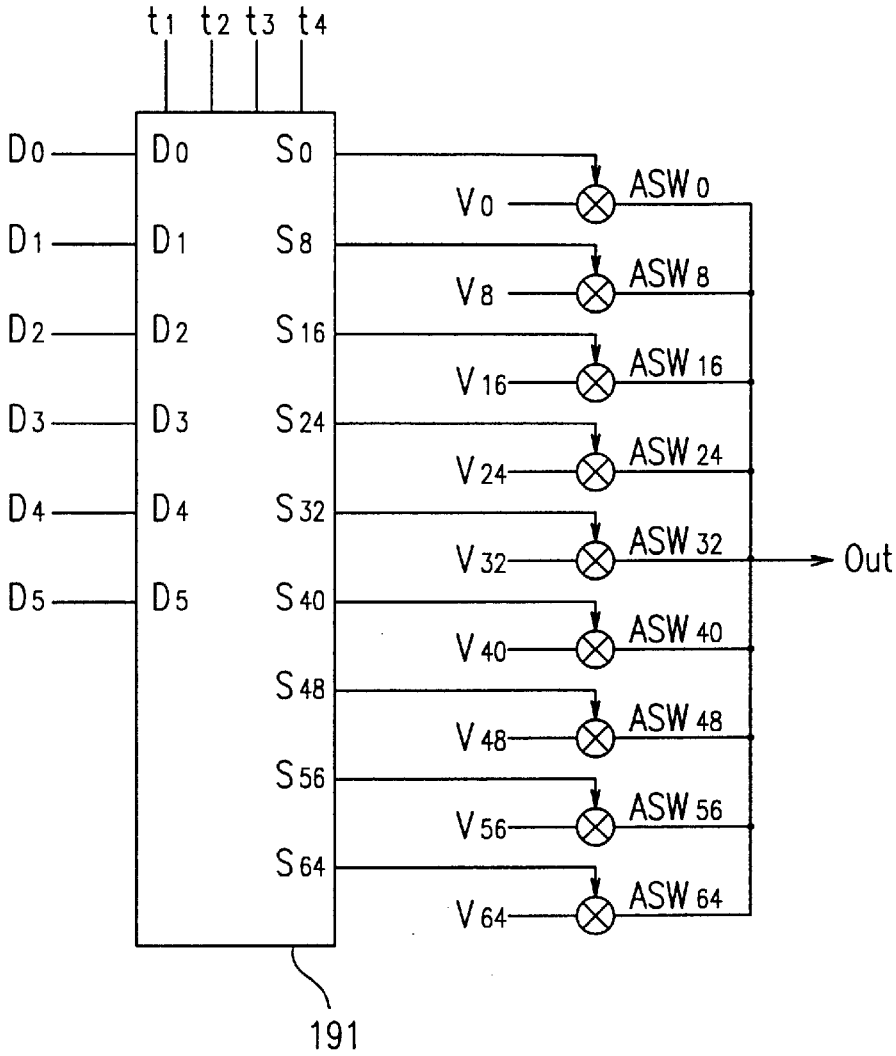
FIG.24A PRIOR ART
FIG. 24A is a block diagram of a driving circuit of a conventional 6-bit digital driver according to the oscillating voltage technique.
Figure 24B:
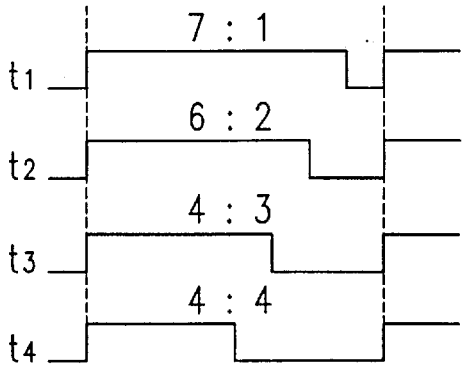
FIG.24B PRIOR ART
FIG. 24B shows waveforms of interpolation signals input into the driving circuit.
Figure 25A:
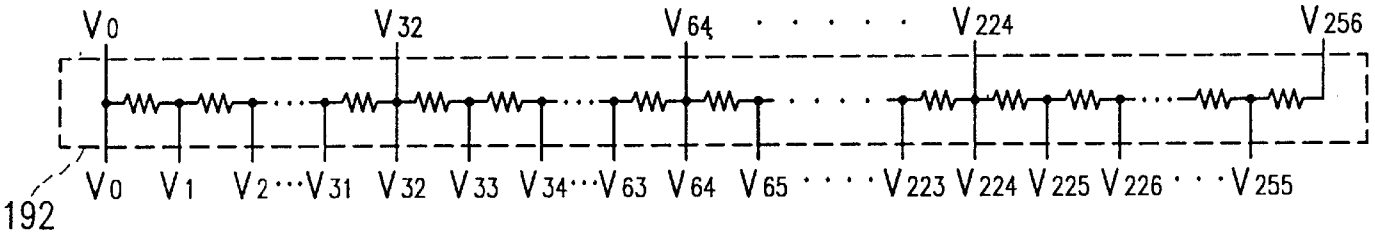
FIG. 25A PRIOR ART
FIG. 25A shows a configuration of a voltage dividing circuit of an 8-bit digital driver to be realized by the resistance division technique.
Figure 25B:
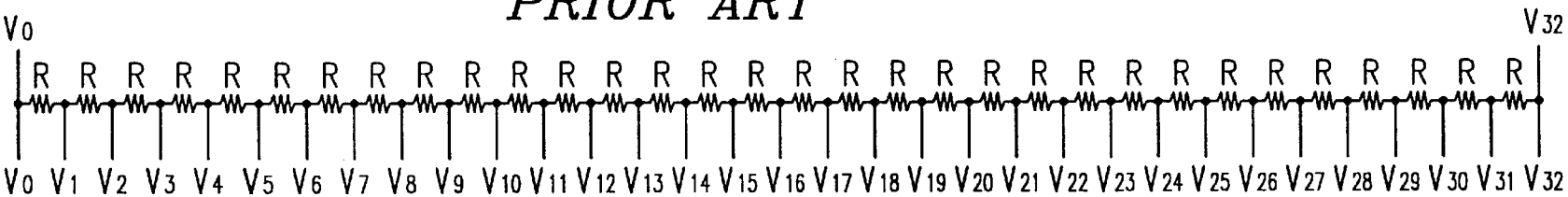
FIG. 25B PRIOR ART
FIG. 25B is a partial view of the voltage dividing circuit of FIG. 25A.
Figure 26:
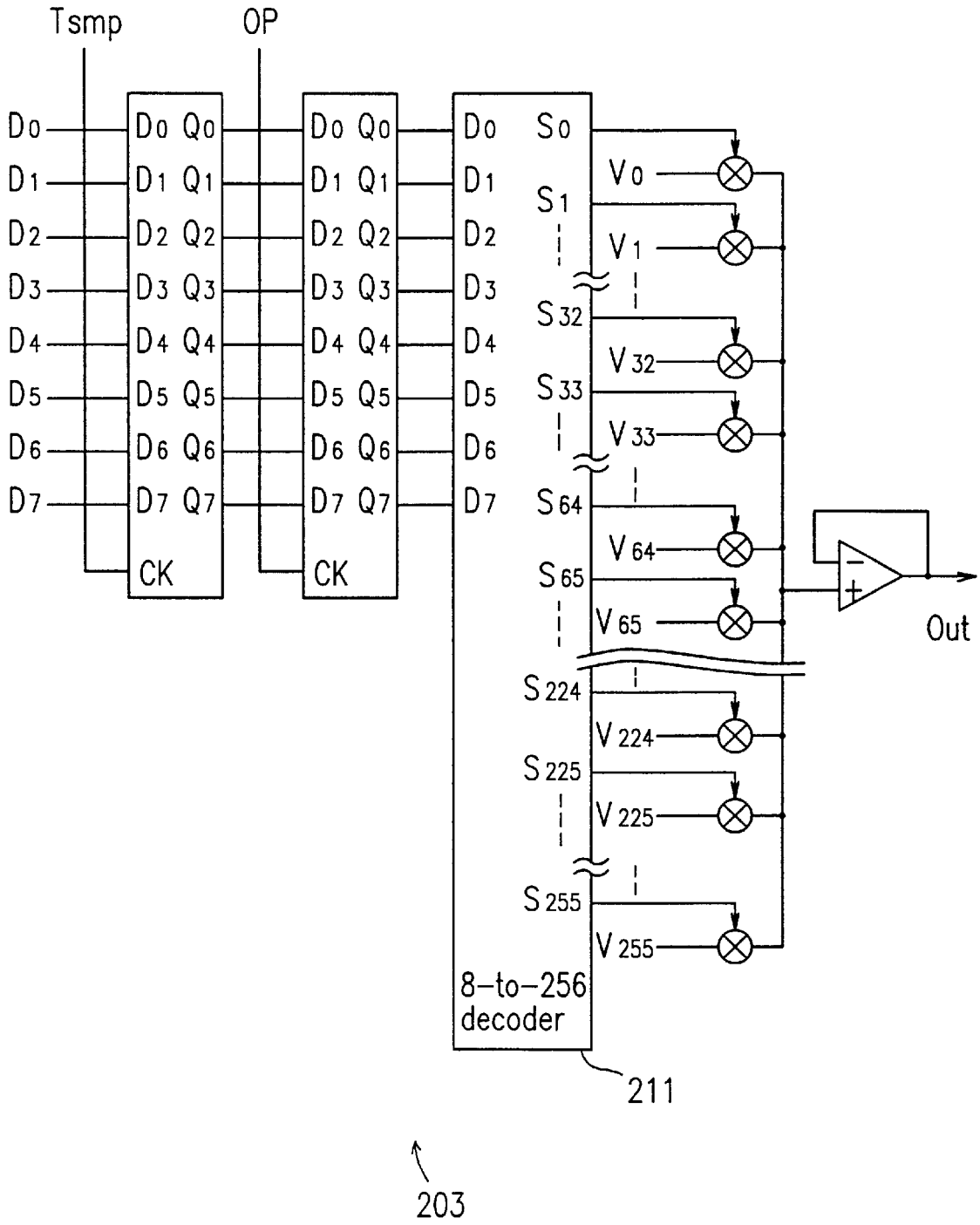
FIG. 26 PRIOR ART
FIG. 26 is a block diagram of an output circuit of an 8-bit digital driver to be realized by the resistance division technique.
Figure 27:
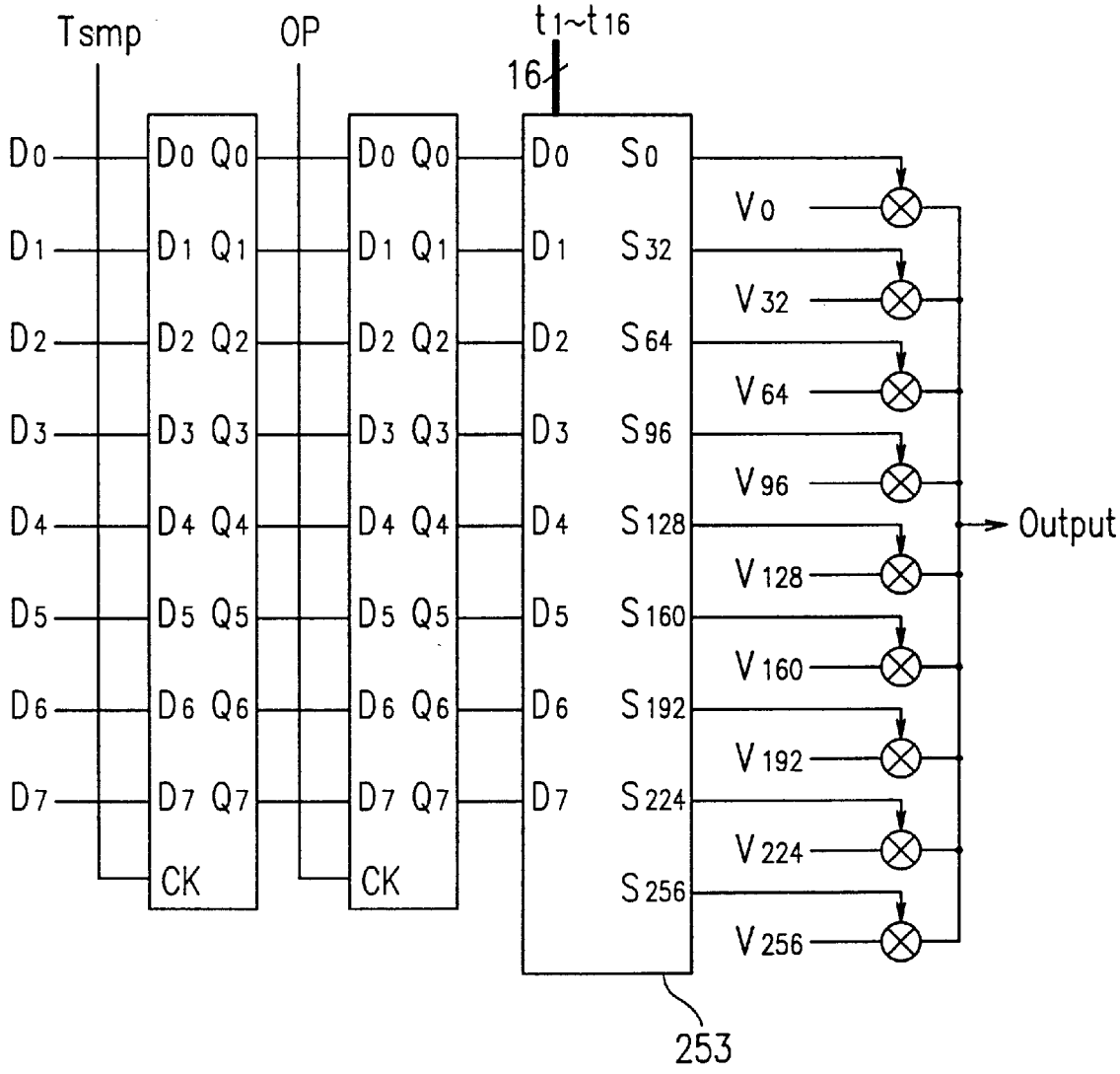
FIG. 27 PRIOR ART
FIG. 27 is a block diagram of a circuit corresponding to one output of an 8-bit digital driver to be realized by the oscillating voltage technique.
Figure 28A:
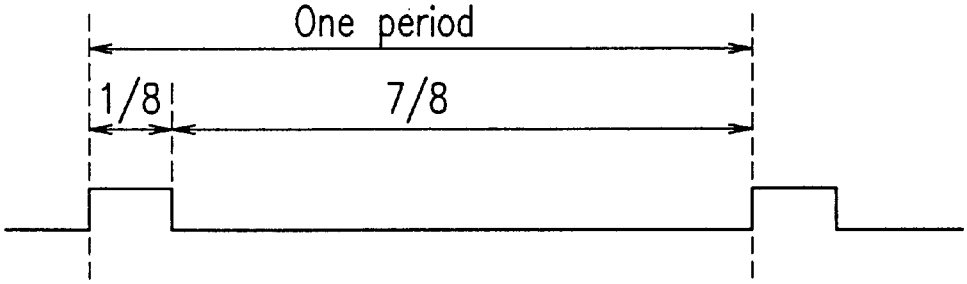
FIG. 28A PRIOR ART
FIGS. 28A shows a waveform of a signal having the minimum pulse width in a 6-bit digital driver.
Figure 28B:
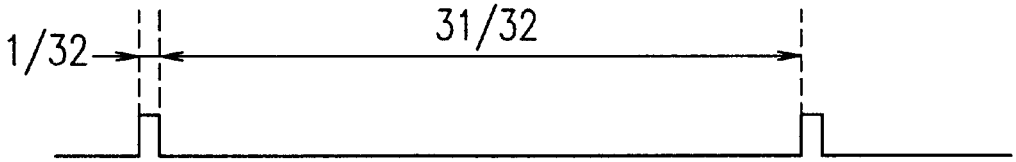
FIG. 28B PRIOR ART
FIGS. 28B shows a waveform of a signal having the minimum pulse width in an 8-bit digital driver.

FIG. 16 shows a configuration of the output circuit 103 shown in FIG. 15. The output circuit 103 includes a logic circuit 111, a voltage dividing circuit 112, a logic circuit 113, and an impedance converter 42.

The logic circuit 111 receives the three most significant bits $D_7$ to $D_5$ of 8-bit digital data, and activates one of eight control signals $S_0$, $S_{32}$, $S_{64}$, $S_{96}$, $S_{128}$, $S_{160}$, $S_{192}$, and $S_{224}$ and one of eight control signals $S_{32}'$, $S_{64}'$, $S_{96}'$, $S_{128}'$, $S_{160}'$, $S_{192}'$, $S_{224}'$, and $S_{256}'$.

Table 4 below is a logic table defining the relationship among the values of the three most significant bits $D_7$ to $D_5$ of the digital data input into the logic circuit 111, the values of the control signals $S_0$, $S_{32}$, $S_{64}$, . . . , $S_{224}$, and the values of the control signals $S_{32}'$, $S_{64}'$, $S_{96}'$, . . . , $S_{256}'$.

TABLE 4

| $D_7$ | $D_6$ | $D_5$ | $S_0$ | $S_{32}$ | $S_{64}$ | $S_{96}$ | $S_{128}$ | $S_{160}$ | $S_{192}$ | $S_{224}$ | $S_{32}'$ | $S_{64}'$ | $S_{96}'$ | $S_{128}'$ | $S_{160}'$ | $S_{192}'$ | $S_{224}'$ | $S_{256}'$ |
|---|---|---|---|---|---|---|---|---|---|---|---|---|---|---|---|---|---|---|
| 0 | 0 | 0 | 1 | | | | | | | | 1 | | | | | | | |
| 0 | 0 | 1 | | 1 | | | | | | | | 1 | | | | | | |
| 0 | 1 | 0 | | | 1 | | | | | | | | 1 | | | | | |
| 0 | 1 | 1 | | | | 1 | | | | | | | | 1 | | | | |
| 1 | 0 | 0 | | | | | 1 | | | | | | | | 1 | | | |
| 1 | 0 | 1 | | | | | | 1 | | | | | | | | 1 | | |
| 1 | 1 | 0 | | | | | | | 1 | | | | | | | | 1 | |
| 1 | 1 | 1 | | | | | | | | 1 | | | | | | | | 1 |

The logic circuit 111 operates in accordance with the logic defined by Table 4. In Table 4, each blank indicates that the value of the control signal is "0". When the value of the control signal is "0" (inactive), the corresponding analog switch is turned off. When the value of the control signal is "1" (active), the corresponding analog switch is turned on.

The control signals $S_0$, $S_{32}$, $S_{64}$, . . . , $S_{224}$ are supplied to analog switches (analog gates) $ASW_0$, $ASW_{32}$, $ASW_{64}$, . . . , $ASW_{224}$, respectively. The control signals $S_{32}'$, $S_{64}'$, $S_{96}'$, . . . , $S_{256}'$ are supplied to analog switches (analog gates) $ASW_{32}'$, $ASW_{64}'$, $ASW_{96}'$, . . . , $ASW_{256}'$, respectively. Each of the analog switches is configured to be turned off when the value of the input control signal is "0" (inactive), and turned on when it is "1" (active).

Gray level voltages $V_0$, $V_{32}$, $V_{64}$, . . . , $V_{224}$ are supplied to the analog switches (analog gates) $ASW_0$, $ASW_{32}$, $ASW_{64}$, . . . , $ASW_{224}$, respectively. Gray level voltages $V_{32}$, $V_{64}$, $V_{96}$, . . . , $V_{256}$ are supplied to the analog switches (analog gates) $ASW_{32}'$, $ASW_{64}'$, $ASW_{96}'$, . . . , $ASW_{256}'$, respectively. Each of the analog switches is configured to output the voltage input therein without any change when it is turned on.

The voltage dividing circuit 112 has four resistances r connected in series. The four resistances r have an equivalent resistance value. The voltage output from the analog switches $ASW_0$, $ASW_{32}$, $ASW_{64}$, . . . , $ASW_{224}$ is applied to one end of the series of the four resistances r, while the voltage output from the analog switches $ASW_{32}'$, $ASW_{64}'$, $ASW_{96}'$, . . . , $ASW_{256}'$ is applied to the other end thereof. The voltage dividing circuit 112 divides the potential difference between the voltages applied to both ends of the series of the four resistances r to generate five different voltages at connecting points $P_0$, $P_1$, $P_2$, $P_3$, and $P_4$. The voltage at the connecting point $P_0$ is equal to the voltage output from the analog switches $ASW_0$, $ASW_{32}$, $ASW_{64}$, . . . , $ASW_{224}$. The voltage at the connecting point $P_4$ is equal to the voltage output from the analog switches $ASW_{32}'$, $ASW_{64}'$, $ASW_{96}'$, . . . , $ASW_{256}'$. The voltages at the connecting points $P_1$, $P_2$, and $P_3$ are equal to voltages obtained by dividing the potential difference between the voltages at the both ends in accordance with the number of the resistances r.

The logic circuit 113 receives the five least significant bits of the 8-bit digital data, and outputs control signals $u_0$, $u_8$, $u_{16}$, $u_{24}$, and $u_{32}$ to analog switches (analog gates) $ASWu_0$, $ASWu_8$, $ASWu_{16}$, $ASWu_{24}$, and $ASWu_{32}$. These analog switches are configured to be turned on when the input control signal is active.

The five voltages obtained in the voltage dividing circuit 112 are supplied to the analog switches $ASWu_0$, $ASWu_8$, $ASWu_{16}$, $ASWu_{24}$, and $ASWu_{32}$. Each of the analog switches is configured to output the voltage input therein without any change when it is turned on.

Table 5 below is a logic table defining the relationship between the values of two bits $D_4$ and $D_3$ among the five least significant bits $D_4$ to $D_0$ of the digital data input into the logic circuit 113 and the values of the control signals $u_0$, $u_8$, $U_{16}$, $u_{24}$, and $u_{32}$ output from the logic circuit 113.

TABLE 5

| $D_4$ | $D_3$ | $u_0$ | $u_8$ | $u_{16}$ | $u_{24}$ | $u_{32}$ |
|---|---|---|---|---|---|---|
| 0 | 0 | T | $\overline{T}$ | | | |
| 0 | 1 | | T | $\overline{T}$ | | |
| 1 | 0 | | | T | $\overline{T}$ | |
| 1 | 1 | | | | T | $\overline{T}$ |

In Table 5, code "T" indicates that the value of the control signal is equal to the value of a parameter T, and code "T bar" indicates that the value of the control signal is equal to the inverted value of the parameter T. In Table 5, each blank indicates that the value of the control signal is "0".

The parameter T is defined by the logic equation represented by Expression (6) below in relation with the values of the three least significant bits $D_2$ to $D_0$ of the digital data and the signals $T_0$ to $T_2$. Expression (6) is the same as Expression (5). The waveforms of the signals $T_0$ to $T_2$ are as shown in FIG. 13.

$$T=\overline{D_0 \cdot T_0+D_1 \cdot T_1+D_2 \cdot T_2} \quad (6)$$

The logic circuit 113 operates in accordance with the logic defined by Table 5 and Expression (6). The logic circuit 113 may have any configuration as long as it can realize the logic defined by Table 5 and Expression (6). For example, the logic circuit 113 may be implemented by a combination of logic elements such as logical AND and logical OR or may be implemented by read-only memories (ROMs). This is also applicable to the logic circuit 111.

Hereinbelow, the operation of the output circuit 103 will be described. Assume that the digital data $D_7$ to $D_0$ corresponding to 2 in the decimal notation, i.e., ($D_7$, $D_6$, $D_5$, $D_4$, $D_3$, $D_2$, $D_1$, $D_0$)=(0, 0, 0, 0, 0, 0, 1, 0) are input into the output circuit 103.

Since all of the three most significant bits $D_7$ to $D_5$ are "0", the logic circuit 111 activates the control signals $S_0$ and $S_{32}'$ in accordance with the logic table of Table 4. Thus, the voltage $V_0$ is applied to one end of the voltage dividing circuit 112 via the analog switch $ASW_0$, while the voltage $V_{32}$ is applied to the other end of the voltage dividing circuit 112 via the analog switch $ASW_{32}'$. In other words, the voltages $V_0$ and $V_{32}$ are applied to the opposite ends of the voltage dividing circuit 112. As a result, voltages $V_0$, $(3V_0+V_{32})/4$, $(2V_0+2V_{32})/4$, $(V_0+3V_{32})/4$, and $V_{32}$ are obtained at the connecting points $P_0$, $P_1$, $P_2$, $P_3$, and $P_4$ of the voltage dividing circuit 112.

The logic circuit 113 selects the control signals $u_0$ and $u_8$ in accordance with the logic table of Table 5 since the two intermediate bits $D_4$ and $D_3$ are both "0". The selected control signals $u_0$ and $u_8$ are controlled by the parameter T. Since the values of the three least significant bits $D_2$ to $D_0$ are "0", "1", and "0", the parameter T is equal to the signal $T_1$ bar from Expression (6).

The control signal $u_0$ is alternately "0"or "1"in accordance with the signal $T_1$ bar. The control signal $u_8$ is alternately "0" or "1" in accordance with the signal $T_1$. The ratio of the period when the control signal $u_0$ is "1" to the period when the control signal $u_8$ is "1" is 6:2 (=3:1). Accordingly, an oscillating voltage which oscillates between the voltage $V_0$ at the connecting point $P_0$ and the voltage $(3V_0+V_{32})/4$ at the connecting point $P_1$ at a duty ratio of 3:1 is output as the output voltage Out.

In the above examples, the driving circuit for an active matrix liquid crystal display device was described. It should be understood, however, that the present invention is also applicable to any display device which effects gray-level display by changing the voltage applied to pixels in accordance with data.

Thus, according to the present invention, a digital driver utilizing advantages of both the resistance division technique and the oscillating voltage technique can be realized. The present invention is especially effective for an 8 or more bit digital driver.

The driving circuit according to the present invention includes a voltage dividing circuit and an output circuit.

The voltage dividing circuit generates a plurality of interpolation voltages between two adjacent gray level voltages in accordance with the resistance division technique. For example, the voltage dividing circuit generates 56 interpolation voltages between nine gray level voltages to output a total of 64 voltages. This level of interpolation can be effectively realized by the resistance division technique.

The output circuit generates a plurality of additional interpolation voltages between voltages output from the voltage dividing circuit by generating oscillating voltages which oscillate between the voltages output from the voltage dividing circuit in accordance with the oscillating voltage technique. The two voltages used for the generation of each oscillating voltage are interpolation voltages obtained from the voltage dividing circuit by interpolating the gray level voltages. Thus, the oscillating voltage obtained according to the present invention oscillates between voltages where the potential difference is small compared with the conventional technique where the oscillating voltage which oscillates between gray level voltages is generated. This generation of an interpolation voltage between voltages where the potential difference is small can be effectively realized by the oscillating voltage technique.

In the oscillating voltage technique, a smaller potential difference between two voltages used for the generation of an oscillating voltage is more advantageous. For example, if the potential difference is reduced to one-eighth, the deviation of the resultant oscillating voltage can be reduced to one-eighth for the same oscillating frequency. Alternatively, the oscillating frequency can be reduced to one-eighth if the deviation of the oscillating voltage is unchanged.

Figure 29A:
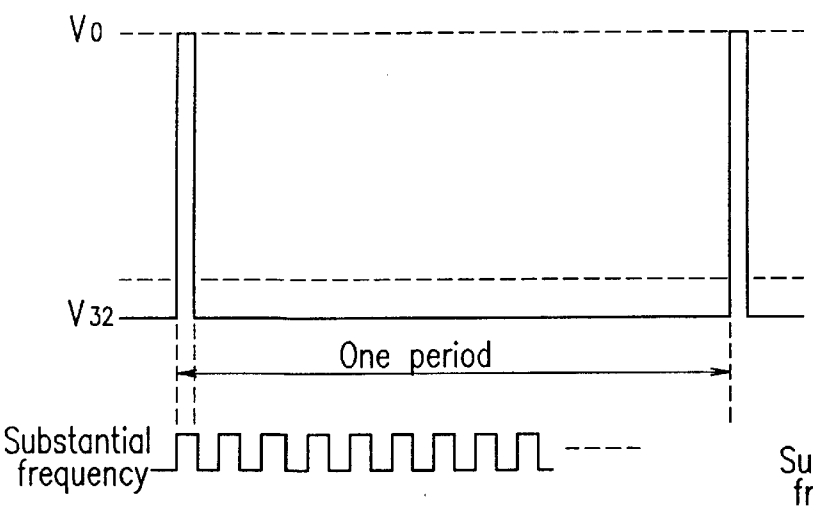
FIG.29A PRIOR ART
FIG. 29A shows a waveform of an oscillating signal having the minimum duty ratio used in a conventional 8-bit digital driver.
Figure 29B:
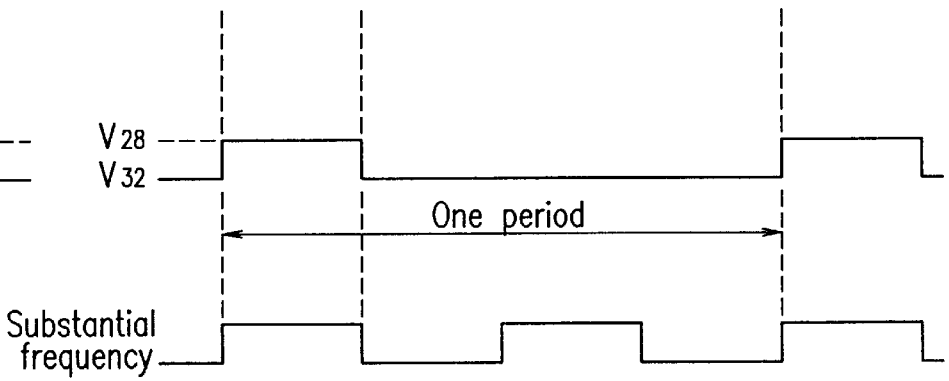
FIG. 29B shows a waveform of an oscillating signal having the minimum duty ratio used in an 8-bit digital driver according to the present invention.

FIG. 29A shows a waveform of an oscillating signal having the minimum duty ratio used in a conventional 8-bit digital driver when the values of digital data correspond to 31. FIG. 29B shows a waveform of an oscillating signal having the minimum duty ratio used in the 8-bit digital driver according to the present invention when the values of digital data correspond to 31. FIGS. 29A and 29B also show substantial frequencies determined by the minimum switch width below the oscillating signals.

The amplitude of the oscillating signal shown in FIG. 29B is one-eighth of that of the oscillating signal shown in FIG. 29A. The substantial frequency shown in FIG. 29B is also one-eighth of that shown in FIG. 29A. Thus, according to the present invention, a driver which suppresses the deviation of the oscillating voltage to one-eighth with a substantial frequency reduced to one-eighth can be designed.

It should be noted that the deviation as described herein determined by the oscillating frequency and the amplitude is only a part of the output deviation occurring in a driver. There are many other factors which cause the output deviation of an actual driver. For example, when an amplifier is used as in the above examples, the variation in the properties of the amplifier may also a cause of the output deviation of a driver, which however will not be described herein since this problem has no relation with the essence of the present invention.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for a display device displaying a plurality of gray levels in accordance with digital data including a first bit portion and a second bit portion, the driving circuit comprising:

a voltage dividing circuit for generating a plurality of interpolation voltages by dividing a plurality of externally-supplied gray-level voltages, each interpolation voltage having a voltage level between the levels of two adjacent ones of the gray level voltages;

a first selection circuit for selecting a first voltage and a second voltage which is different from the first voltage from among the plurality of gray level voltages and the plurality of interpolation voltages based on the first bit portion of the digital data, wherein at least one of the first and second voltages is one of the generated interpolation voltages;

a second selection circuit for selecting one of a plurality of oscillating signals having different duty ratios based on the second bit portion of the digital data; and an output circuit for outputting an oscillating voltage which oscillates between the first voltage and the second voltage selected by the first selection circuit at a duty ratio of the oscillating signal selected by the second selection circuit.

2. A driving circuit according to claim 1, further comprising an impedance converter connected to the output circuit.

3. A driving circuit for a display device displaying a plurality of gray levels in accordance with digital data including a first bit portion, a second bit portion, and a third bit portion, the driving circuit comprising:

a first selection circuit for selecting a first gray level voltage and a second gray level voltage which is different from the first gray level voltage from among a plurality of gray level voltages supplied externally based on the first bit portion of the digital data;

a voltage dividing circuit for generating a plurality of interpolation voltages between the first gray level voltage and the second gray level voltage by dividing a potential difference between the first gray level voltage and the second gray level voltage;

a second selection circuit for selecting a first voltage and a second voltage which is different from the first voltage from among the first gray level voltage, the second gray level voltage, and the plurality of interpolation voltages based on the second bit portion of the digital data;

a third selection circuit for selecting one of a plurality of oscillating signals having different duty ratios based on the third bit portion of the digital data; and an output circuit for outputting an oscillating voltage which oscillates between the first voltage and the second voltage selected by the second selection circuit at a duty ratio of the oscillating signal selected by the third selection circuit.

4. A driving circuit according to claim 3, further comprising an impedance converter connected to the output circuit.

5. A driving circuit according to claim 1, wherein the first and second voltages are adjacent voltages output by said voltage dividing circuit.

6. A driving circuit according to claim 3, wherein at least one of the first and second voltages is one of the interpolation voltages.

7. A driving circuit according to claim 3, wherein the first and second voltages are adjacent voltages output by said voltage dividing circuit.

8. A driver for a display device displaying a plurality of gray levels, said driver comprising:

a voltage dividing circuit configured to divide a plurality of gray level voltages to generate interpolation voltages each of which has a voltage level between the levels of two adjacent ones of the gray level voltages, and to output the gray level voltages and the interpolation voltages; and driver circuits each of which is supplied with the gray level voltages and the interpolation voltages output by said voltage dividing circuit and each of which is configured to output an output voltage based on digital data supplied thereto, wherein each driving circuit is responsive to certain values of the digital data supplied thereto for outputting as the output voltage a voltage that oscillates between two adjacent voltages output by said voltage dividing circuit, whereby at least one of the two adjacent voltages is one of the interpolation voltages generated and output by the voltage dividing circuit.

9. A driver according to claim 8, wherein a total number of the gray level voltages and the interpolation voltages is less than half of a number of output voltages determinable by the digital data supplied to said driving circuits.

10. A driver according to claim 8, further comprising:

impedance converters provided for the outputs of said voltage dividing circuit.

11. A driver according to claim 8, wherein said driving circuits are further supplied with first and second signals usable to set a duty ratio of the oscillating voltage.

12. A driver according to claim 11, wherein a predetermined number of bits of the digital data supplied to each driving circuit is used to select one or the other of the first and second signals, to thereby set the duty ratio of the oscillating voltage at the duty ratio of the selected one or the other of the first and second signals.

13. A driver according to claim 8, wherein each of the two adjacent voltages is a respective one of the interpolation voltages.

14. A driver according to claim 8, wherein the digital data supplied to said driving circuits is 8-bit digital data.

15. A driver according to claim 8, wherein the digital data supplied to said driving circuits is digital data of 8 or more bits.

16. A driver according to claim 8, wherein a predetermined number of bits of the digital data supplied to each driving circuit is used to select the two adjacent voltages.

17. A driver for a display device for displaying a plurality of gray levels, said driver comprising:

voltage dividing circuits each of which is configured to divide a plurality of gray level voltages to generate interpolation voltages each of which has a voltage level between the levels of two adjacent ones of the gray level voltages, and to output the gray level voltages and the interpolation voltages;

driving circuits each of which is supplied with the gray level voltages and the interpolation voltages output by a respective corresponding one of said voltage dividing circuits, and each of which is configured to output an output voltage based on digital data supplied thereto, wherein each driving circuit is responsive to certain values of the digital data supplied thereto for outputting as the output voltage a voltage that oscillates between two adjacent voltages output by the respectively corresponding voltage dividing circuit, whereby at least one of the two adjacent voltages is one of the interpolation voltages generated and output by the respectively corresponding voltage dividing circuit.

18. A driver according to claim 17, wherein each of the two adjacent voltages is a respective one of the interpolation voltages.

19. A driver according to claim 17, wherein the digital data supplied to said driving circuits is 8-bit digital data.

20. A driver according to claim 17, wherein the digital data supplied to said driving circuits is digital data of 8 or more bits.

21. A driver according to claim 17, wherein said driving circuits are further supplied with first and second signals usable to set a duty ratio of the oscillating voltage.

22. A driver according to claim 21, wherein a predetermined number of bits of the digital data supplied to each driving circuit is used to select one or the other of the first and second signals, to thereby set the duty ratio of the oscillating voltage at the duty ratio of the selected one or the other of the first and second signals.

23. A driver according to claim 17, wherein a predetermined number of bits of the digital data supplied to each driving circuit is used to select the two adjacent voltages.

24. A driver according to claim 8, wherein each driving circuit is responsive to certain other values of the digital data supplied thereto for outputting as the output voltage a voltage that is one of the gray level and interpolation voltages output by said voltage dividing circuit.

25. A driver according to claim 17, wherein each driving circuit is responsive to certain other values of the digital data supplied thereto for outputting as the output voltage a voltage that is one of the gray level and interpolation voltages output by the respectively corresponding voltage dividing circuit.

* * * * *